United States Patent [19]

Wolfthal

[11] 4,287,748

[45] Sep. 8, 1981

[54] ROTARY TRANSFER PRESS APPARATUS

[75] Inventor: Maurice Wolfthal, Ossining, N.Y.

[73] Assignee: Stewart Stamping Corp., Yonkers, N.Y.

[21] Appl. No.: 79,968

[22] Filed: Sep. 28, 1979

[51] Int. Cl.[3] ..... B21D 43/14; B21K 27/00

[52] U.S. Cl. ..... 72/405; 29/38 C; 29/564; 29/565; 72/421; 74/813 L; 74/817; 74/827; 83/267; 83/411 R; 83/552

[58] Field of Search ..... 72/405, 404, 419, 421; 29/38 C, 564, 565; 83/552, 267, 513, 411 R; 74/813 L, 817, 827

[56] References Cited

U.S. PATENT DOCUMENTS

| | | | |
|---|---|---|---|
| 1,005,622 | 10/1911 | Eisenbeis | 72/419 |
| 2,282,959 | 5/1942 | Gibbs | 72/405 |
| 2,880,777 | 4/1959 | Perri | 29/38 C |
| 3,160,046 | 12/1964 | Bredow | 83/552 |
| 3,527,130 | 9/1970 | Knehans | 83/552 |

FOREIGN PATENT DOCUMENTS

| | | | |
|---|---|---|---|
| 587290 | 1/1959 | Italy | 72/405 |

*Primary Examiner*—Gene P. Crosby
*Attorney, Agent, or Firm*—Steinberg & Raskin

[57] ABSTRACT

A rotary transfer press apparatus wherein a plurality of workpieces are simultaneously and progressively moved over a circular path through a series of working stations which themselves are arranged in a circular path whereby successive operations are performed on each workpiece to obtain a finished product for each cycle of the press.

21 Claims, 25 Drawing Figures

(BOTTOM DEAD CENTER)

FIG.4E
(PT. B' OF FIG. 5)
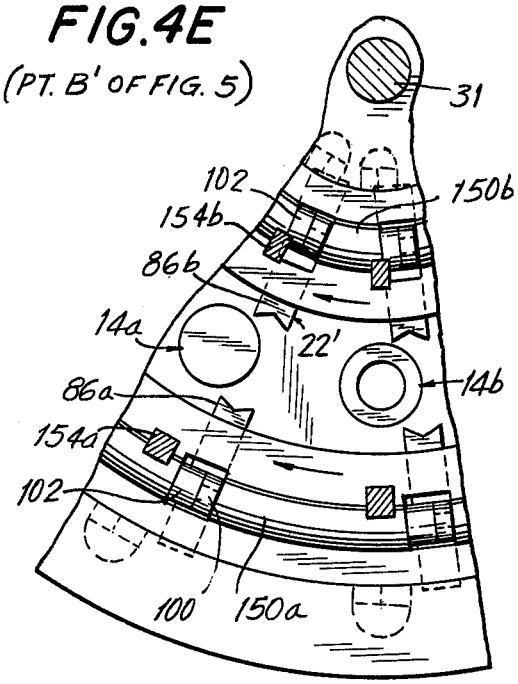
FIG.4F
(PT. B OF FIG. 5)
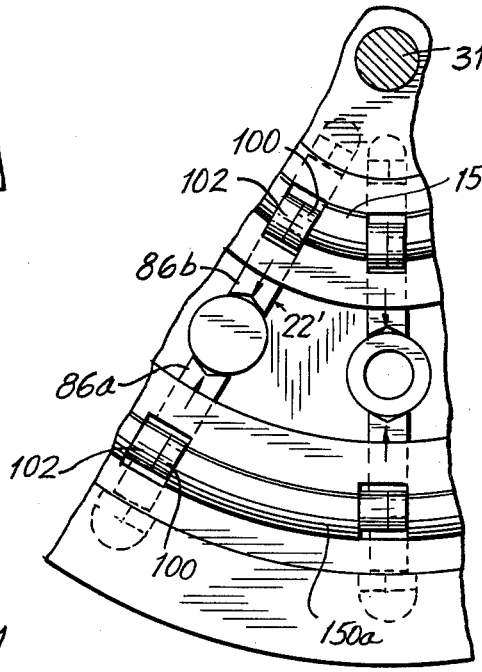
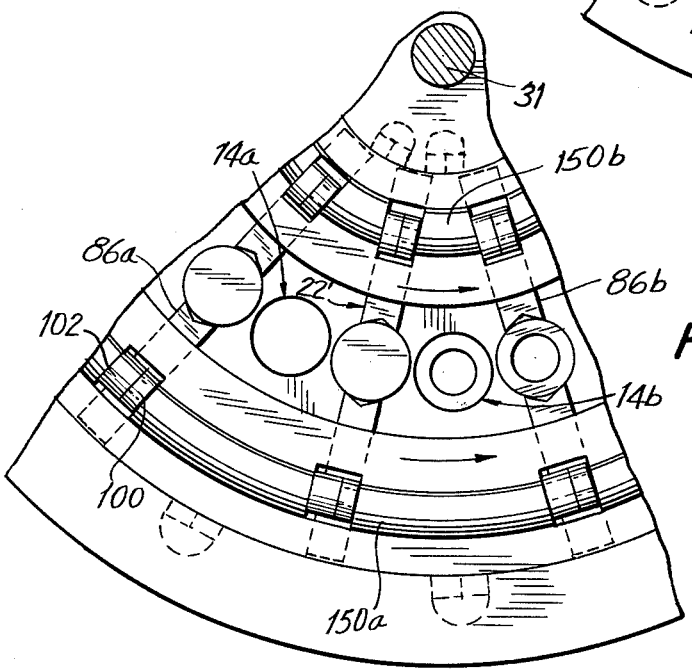
FIG.4G
(TOP DEAD CENTER)

ROTARY TRANSFER PRESS APPARATUS

BACKGROUND OF THE INVENTION

This invention relates generally to transfer presses and, more particularly, to transfer presses of the type wherein workpieces are stamped and/or drawn in a progressive manner at successive working stations, the shape, size and/or configuration of the workpiece changing from station to station.

Transfer presses of the type wherein a workpiece is progressively drawn at successive drawing stations are of course well known. More particularly, it is common in such transfer presses for the outer shape of the workpiece to change from station to station. In such cases, movable fingers have been utilized to assist in transferring the workpiece from station to station.

Generally, in transfer presses where the shape of the workpiece changes from station to station, the drawing dies for the particular job are arranged in a rectilinear fashion, i.e., the dies are arranged in the die block with a common straight centerline. A plurality of pairs of transfer fingers are provided, the function of each pair of transfer fingers being to grasp a workpiece subsequent to its being cut or formed at a working station, transfer the workpiece to the next working station, release the same in conjunction with a succeeding drawing operation and return to the first working station in a manner timed so that the next workpiece has been already formed whereupon the pair of transfer fingers can grasp this workpiece and continue through the next transfer cycle. The transfer fingers of a particular transfer finger pair are located on opposite sides of the common centerline of the die block and means are provided for moving the transfer fingers in timed coordination with the movement of the draw punches, firstly towards each other at a first work station whereupon the workpiece formed therein is grasped, and secondly in a rectilinear direction transverse to this first inward motion to transfer the workpiece to the next die. Upon the grasped workpiece finally arriving at the next working station, the transfer fingers now move away from each other to release the workpiece for subsequent working operations at this next die. Finally, the transfer fingers return to the first working station by again moving in a rectilinear fashion back to the first working station in preparation for transferring the subsequently formed workpiece in a similar manner.

Transfer presses of the type described above are well known and are currently manufactured by companies such, for example, at the U.S. Baird Corporation of Stratford, Connecticut and M. S. Willet, Inc. of Cockeysville, Maryland. Such transfer presses can be termed "linear transfer presses" to denote the fact that the dies are arranged in the holding block in a linear fashion as described above. The workpiece is moved from station to station in a straight line and the transfer fingers similarly move only linearly during operation of the press. Prior to the present invention, transfer presses of the "linear" type have been exclusively used in connection with jobs wherein the outer shape of the workpiece changes from station to station.

However, linear transfer presses have certain disadvantages. For example, in jobs which require a large number of drawing operations and, correspondingly, a large number of drawing dies, the rectilinear arrangement of the dies in the die block requires a large amount of space on the floor to be allocated to the press. Not only does this take up valuable space but, further, the full tonnage capabilities of the press cannot be most efficiently utilized over a long die block. Linear transfer presses are relatively slow due to the fact that the workpiece transfer operation is most often the limiting factor in the rate of production. The linear arrangement of the dies also generally necessitates a relatively long pitch, i.e. a substantial distance between adjacent dies. However, the longer the distance which the workpiece must travel between dies, in addition to resulting in a longer press, also decreases the speed of the press, i.e., fewer strokes per minute can be achieved.

Further, in conventional linear transfer presses, the pitch and center spacing of successive drawing stations is fixed once the press is designed. In other words, the working stations are integral parts of the press structure. This is disadvantageous in that the flexibility of the linear transfer press is severely limited, i.e., a linear transfer press can be used only for transfer press operations and cannot be converted not use as a conventional press. Similarly, it is generally for possible for a more complex progressive die to be used in conventional transfer presses due to the lack of availability of space therefor.

Linear transfer presses which are currently available are fairly complex in construction and are quite expensive.

Certain conventional linear transfer presses have other important disadvantages. More particularly, certain linear transfer presses do not have the capability of positively controlling the workpiece, i.e., positively grasping the workpiece, in a continuous manner from the initial blanking station to the final working station. In some cases, the workpiece will "float" either during the transfer operation or during part of the drawing operation thereby preventing close tolerances from being obtained and often resulting in misfeeds and the like. In many cases, the tooling, e.g., the dies, are not easily accessible for purposes of replacement thereby requiring a large amount of time for tool replacement either during normal maintenance or during job changes. A further disadvantage exists in some linear transfer presses in that the transfer apparatus, e.g., the plurality of pairs of transfer fingers, often at some time during operation of the machine pass through the path of the tooling. In these cases, it is not uncommon for the tooling and transfer apparatus to collide with each other requiring expensive repair and down-time for the machine.

The workpiece transfer apparatus used in certain conventional linear transfer presses are not entirely satisfactory. Thus, the transfer fingers are often only spring loaded and, consequently, must rub across the workpiece to open. This leads to an inaccurate positioning of the workpiece and, therefore, improper tolerances. The proper operation of the transfer apparatus is, of course, critical to accurate timing and overall operation of the press.

SUMMARY OF THE INVENTION

Accordingly, one object of the present invention is to provide new and improved transfer press apparatus of the type wherein workpieces are stamped and/or drawn in a progressive manner at successive working stations so that the shape of the workpiece changes from station to station.

Another object of the present invention is to provide new and improved transfer press apparatus wherein a large number of working stations can be provided to perform a correspondingly large number of drawing operations while maintaining to a minimum the space requirements for the apparatus.

Still another object of the present invention is to provide new and improved transfer press apparatus wherein the loading capability of the press is utilized in an efficient manner, i.e., wherein essentially the full tonnage of the press is available for the material shaping operations performed at each working station.

Yet another object of the invention is to provide new and improved transfer press apparatus having a high rate of production and wherein the transfer of the workpieces between successive working stations is accomplished in a fast and efficient manner so that the production rate of the apparatus is not limited thereby.

Another object of the present invention is to provide new and improved transfer press apparatus wherein the die plate and associated die structure may be easily replaced so that the pitch and center spacing between successive working stations may be varied as desired.

Still yet another object of the present invention is to provide new and improved transfer press apparatus wherein each workpiece is positively controlled, i.e., is positively grasped by appropriate components from the initial blanking station to the final working station of the apparatus.

A further object of the present invention is to provide new and improved transfer press apparatus wherein the tooling, e.g., the dies, are readily accessible for the purposes of replacement and/or repair.

A still further object of the present invention is to provide new and improved transfer press apparatus wherein the apparatus for transferring the workpieces from station to station does not at any time move into a potentially obstructing relationship with respect to the tooling of the press apparatus, e.g., the draw punches on the upper die.

Another object of the present invention is to provide new and improved transfer press apparatus which can be converted to conventional press operation.

Yet another object is to provide a new and improved transfer press apparatus which has the capability of utilizing a more complex progressive die to stamp, pierce or otherwise prepare a workpiece which can then be introduced into the press apparatus for subsequent transfer operations.

An additional object of the present invention is to provide new and improved transfer press apparatus which is both simple in construction and inexpensive in manufacture relative to conventional transfer press apparatus.

Briefly, in accordance with the present invention, these and other objects are attained by providing transfer press apparatus of a rotary type wherein a plurality of workpieces, sequentially blanked at an initial blanking station, are progressively moved along a circular path to successive working stations, the dies of which are arranged with respect to each other in a circular fashion, i.e., the dies are arranged in the die block having a common circular centerline rather than in a rectilinear fashion as is conventional. The workpieces are positively carried from each station to the next successive station by transfer apparatus which move in a oscillatory manner along a path defined by a sector of the circle defined by the plurality of dies.

The transfer press apparatus of the present invention, referred to below as a "rotary" transfer press to distinguish the same from the "linear" type of transfer press of the prior art, comprises to applicant's knowledge the first time that workpieces are progressively moved or rotated to successive drawing stations which are arranged in a circular fashion so that the outer shapes or configurations of the workpieces change at each or substantially each working station. Thus, although rotary indexers are known wherein workpieces are rotated to circularly arranged working stations wherein operations such as drilling or tapping are performed, in the operation of such known apparatus, the outer configurations of the workpieces do not substantially change. Thus, the present invention constitutes press apparatus wherein for the first time a workpiece is transferred along a circular path to a plurality of working stations wherein the geometrical configuration of the workpiece changes during the circular or rotary transfer of the workpiece from station to station.

Thus, according to the present invention, a rotary transfer press apparatus is provided wherein each of a plurality of workpieces is sequentially transferred to a plurality of successive working stations so that the workpiece is successively formed to obtain a finished product. The transfer press apparatus includes a lower die defined by a fixed die block having a plurality of successive working stations arranged along a substantially circular path. The plurality of circularly arranged working stations are adapted to perform corresponding successive stamping or forming operations on a workpiece which itself is transferred along the circular path to each successive working station until a finished product is obtained subsequent to the last of the forming operations. Each of the working stations includes a die member which is appropriately formed to perform one of the successive forming operations on each of the plurality of workpieces which is sequentially transferred into association therewith during its travel along the circular path.

A vertically reciprocatable upper press platen is located over the die block on which are mounted a plurality of draw punches, each of which extends coaxially with respect to the die member associated with a corresponding working station in the fixed die block. The draw punches have lower working end regions which are adapted to enter into and withdraw from the die members in corresponding working stations at substantially the same time during each cycle of the upper press platen so as to perform a forming operation on the workpieces located in the respective working stations. More particularly, the upper press platen is continuously vertically reciprocated or cycled at a certain rate wherein such cycle includes a downward stroke portion wherein the upper press platen travels from top dead center to bottom dead center and an upward stroke portion wherein the upper press platen returns from the bottom dead center to top dead center.

Apparatus is provided for sequentially transferring each of the plurality of workpieces along the circular path defined by the working stations in a manner such that each workpiece is sequentially carried to each of the successive working stations where corresponding successive forming operations are performed thereon. The transfer apparatus advances each workpiece from one working station where a forming operation is performed thereon during a press cycle to the next successive working station in preparation for the next successive forming operation which is performed during the immediately following press cycle.

In the illustrated preferred embodiment of the present invention, the workpiece transfer apparatus comprise a plurality of pairs of opposed transfer fingers, each transfer finger pair being adapted to carry a workpiece from a particular working station to the next succeeding working station for each cycle of the press. Thus, in the illustrated preferred embodiment, the workpiece at a particular working station is positively gripped by the transfer fingers during the upward stroke portion of the upper press platen subsequent to the forming operation at that particular work station. The transfer finger pair having the workpiece gripped therebetween is advanced in a circular path to the next successive working station over a period of time which corresponds to the terminal portion of the upward stroke portion and the initial portion of the downward stroke portion. The workpiece is then released by the transfer fingers upon reaching the next working station at a time during the downward stroke portion of the upper press platen prior to the draw punch which cooperates with the die member in the next successive working station contacting the workpiece whereupon the transfer finger pair returns to the initial working station over a period of time corresponding to the terminal portion of the downward stroke portion and the initial portion of the next upward stroke portion. Upon returning to the original working station, the transfer finger pair grips the next workpiece and the same operations are repeated.

Apparatus are provided on both the lower die and upper press platen for actuating the movement of the transfer fingers in the manner described above. More particularly, the transfer fingers are carried in a transfer ring assembly which itself is mounted around the die block for oscillating movement with respect thereto, the transfer ring being oscillated by a suitable connection with the press drive apparatus. The transfer fingers of each pair are continuously biased towards a closed mutual relationship but are retained in a spaced, open relationship during the return of the transfer finger pair from a subsequent to a previous working station through cooperation of latch mechanisms pivotally connect to the fingers and respective circular channels formed in the die block. Upon completion of the return movement of the transfer fingers, i.e., when the fingers are aligned with the previous working station, the latch mechanisms are released by virtue of their engagement with ramps located in the circular channels in locations which are radially aligned with each working station, which ramps cause the latch mechanisms to pivot upwardly to unlock the transfer fingers from their retained open position.

In addition to the various punches, the upper press platen has a plurality of pairs of cam members mounted thereto, each cam member pair being located over radially opposed sides of a respective working station at a location such that they will engage appropriate cam surfaces formed on respective pairs of transfer fingers upon the latter moving into aligned position with a particular working station and while the upper press platen is below a certain vertical height during its cycle. Thus, at the completion of the return movement of the transfer finger pairs, the upper press platen is in its upward stroke portion and the cam members are adapted to engage the cam surfaces of the transfer fingers substantially simultaneously with the latch mechanism being unlocked. As the upper press platen continues its upward movement, the cam members also move upwardly so that the biased transfer fingers move inwardly to a closed position in a controlled manner determined by the gradual disengagement of the cam members and the cam surfaces of the transfer fingers. The workpiece which had been subjected to a forming operation in the working station during the immediately previous downward stroke portion of the same press cycle is simultaneously elevated from the die member by ejection apparatus to a location above the die block so that it can be positively grasped by the closing transfer fingers. Of course, the transfer ring which carries the transfer fingers dwells or remains stationary during this period of time.

After the workpiece has been grasped as described above and the dwell period ends, the transfer ring is advanced so that each pair of transfer fingers carries its grasped workpiece to the next successive working station. Thus, the workpiece carrying transfer finger pairs are advanced while the upper press platen moves upwardly to its top dead center position and begins its downward stroke portion, the advancement of the transfer ring and associated transfer fingers ending when the workpiece is located over the die member of the next successive working station.

Substantially immediately after the workpiece is located over the die member of the next successive working station, the cam members on the downwardly moving upper press platen engage the cam surfaces on the respective transfer finger pairs and as the downward movement continues, the transfer fingers of each pair are urged away from each other under the camming force of the cam members so as to release the workpiece. During this time, the finger carrying transfer ring is stationary or in a dwell period. Preferably, immediately prior to the cam members engaging the cam surfaces of each transfer finger pair, a spring biased movable plunger axially disposed within each punch contacts the upwardly facing surface of the workpiece so that the latter is positively held by the punch plunger and a lower spring biased plunger located in the die block and which is movable through the die member. In this manner, upon each transfer finger pair being moved towards its "open" configuration, the workpiece will still be held in a positive manner so that it does not "float". Thus, the transfer fingers of each finger pair are moved outwardly away from each other as described above and are maintained in this "open" configuration through the continuous engagement of the cam members with the respective cam surfaces of the transfer fingers during the downward stroke of the press. The latch mechanisms are prevented from entering the circular channels formed in the die block while the fingers are radially aligned with the working stations by virtue of the ramps located in the circular channels at these positions.

The upper press platen continues to move downwardly so that the workpiece is pushed into the die member whereupon it is shaped according to the configuration of the particular die member into which the workpiece is forced. Substantially simultaneous with the draw punch engaging the workpiece, i.e., when the punch descends to the level of the die block, the transfer ring initiates a preferably clockwise return movement. At this time, upon the transfer fingers moving out of radial alignment with the working stations, the latch mechanisms, which had been located over the circular channels in the die block by virtue of their outward movement described above but which had not pivoted into locking engagement therewith due to the presence of the ramps, now pivot downwardly to engage the channels thereby locking the transfer fingers in their "open" configuration. The transfer ring continues its return movement until the respective pairs of transfer fingers are aligned with the previous respective working stations where the workpieces which had been formed during the press cycle are located for transfer to the next successive working station.

The operations described above are then repeated so that in this manner the workpieces are sequentially transferred in a preferably counterclockwise circular direction to each of the successive working stations.

The apparatus preferably further includes an initial blanking station provided in the die block prior to the first working station. A blanking die is located directly over the blanking station. Stock material is intermittently fed over the blanking die in timed relation with the press cycling whereupon workpieces are punched from the stock during each press cycle. In this connection, apparatus may be provided for performing a 2-up blanking operation. In this embodiment, a pair of workpieces are punched during alternate press cycles one of which is immediately punched into working position, and additional apparatus are provided for transferring the other of the pair of punched workpieces during alternate press cycles into a position over the blanking station.

As mentioned above, subsequent to each forming operation, the workpiece is elevated from within the die member. In most cases the formed workpiece will be stripped from the draw punch by a spring biased plunger provided in the punch. However, in certain cases, the die member will be adapted to perform a forming operation which results in a workpiece which cannot be stripped from the punch in this manner. In such cases, a solid stripper apparatus is provided over the particular working stations to strip the workpiece from the respective draw punch.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which:

FIGS. 4A–G are schematic views illustrating the sequence of operations in connection with the transfer of a workpiece from one working station to the next successive working station according to the present invention;

DESCRIPTION OF THE PREFERRED EMBODIMENT

General Assembly

Figure 1:
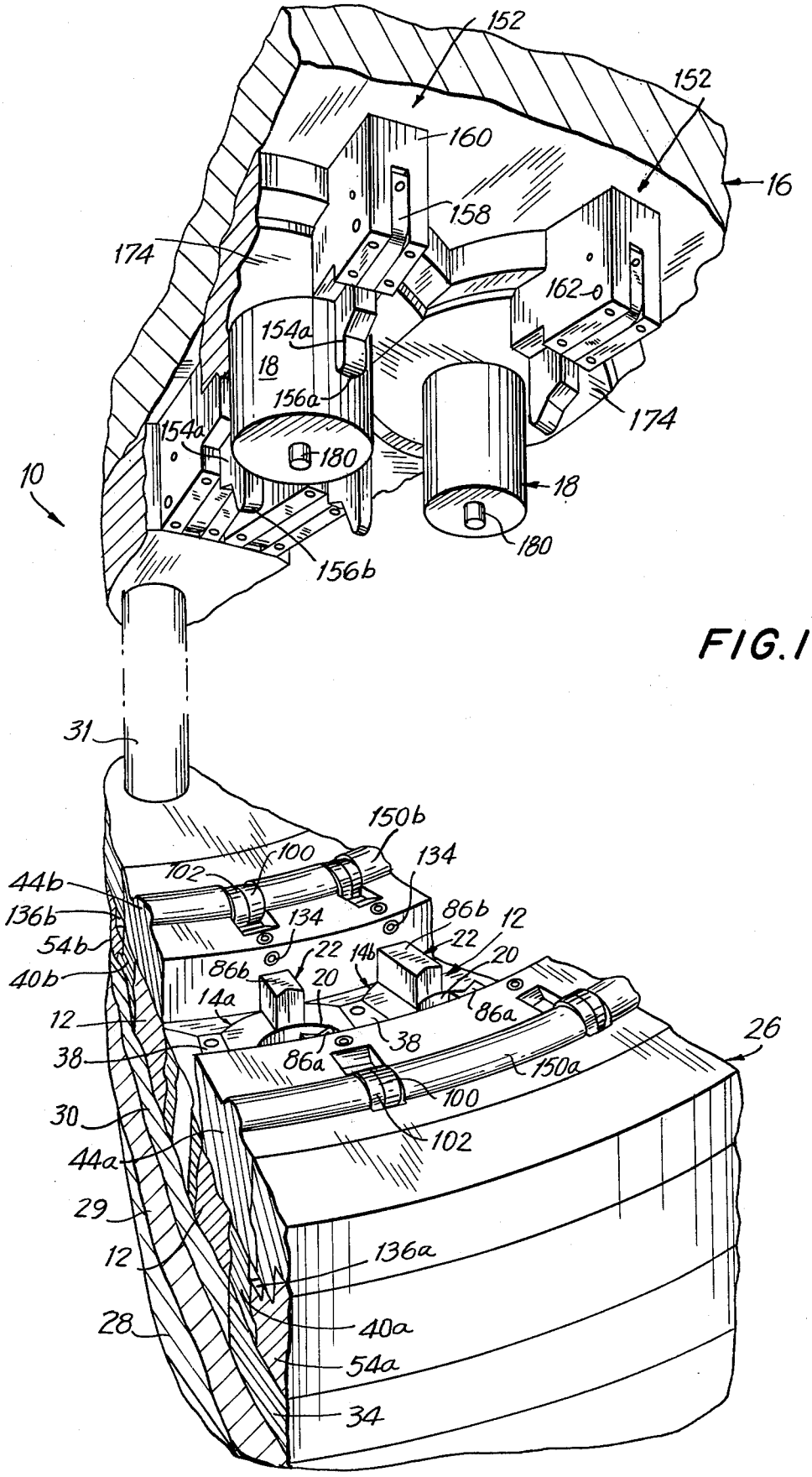
FIG. 1 is a schematic perspective view of a section of the lower die and the opposed section of the upper press platen according to the present invention.
Figure 2:
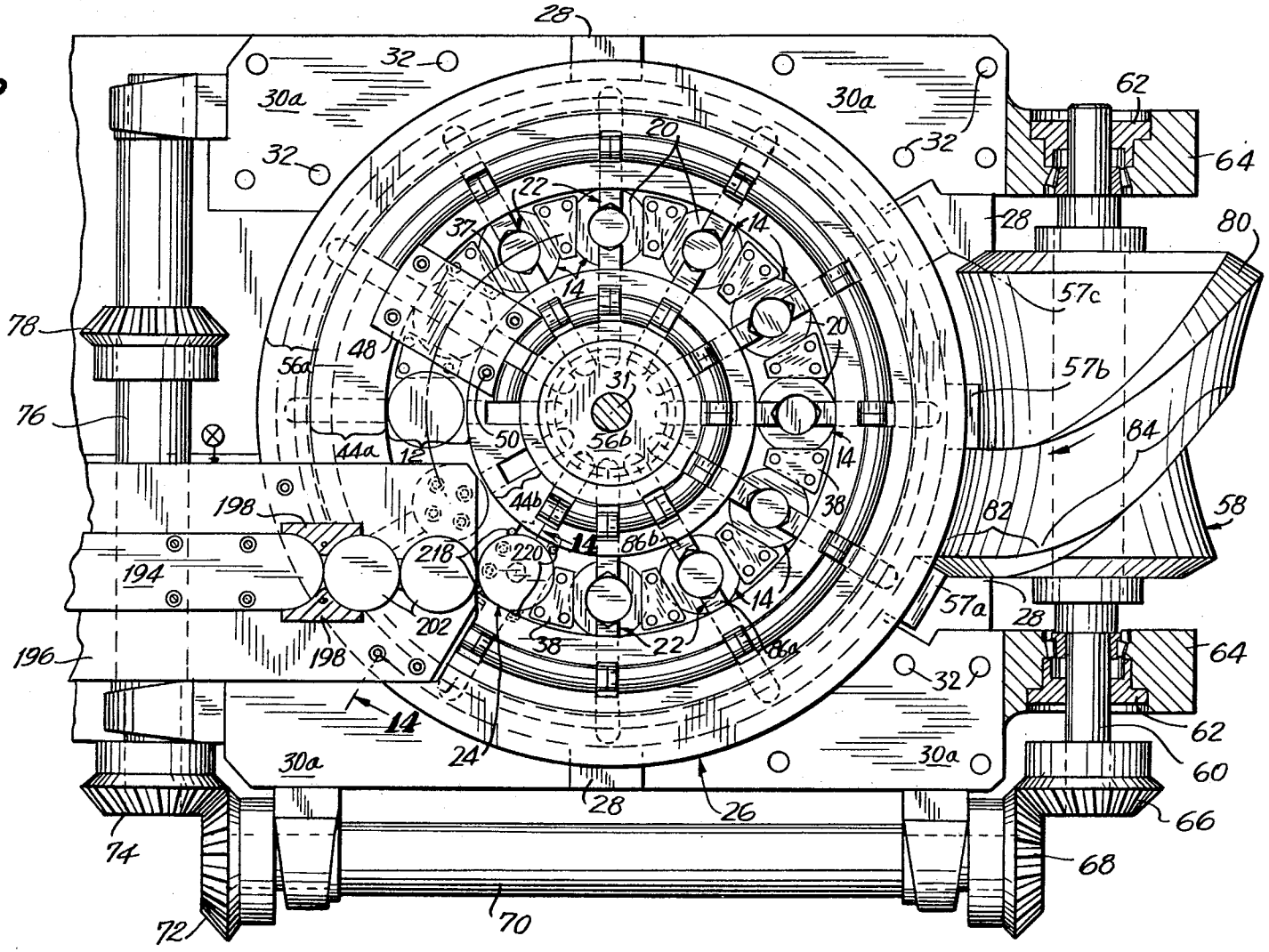
FIG. 2 is a top plan view of the lower die of the present invention.
Figure 3:
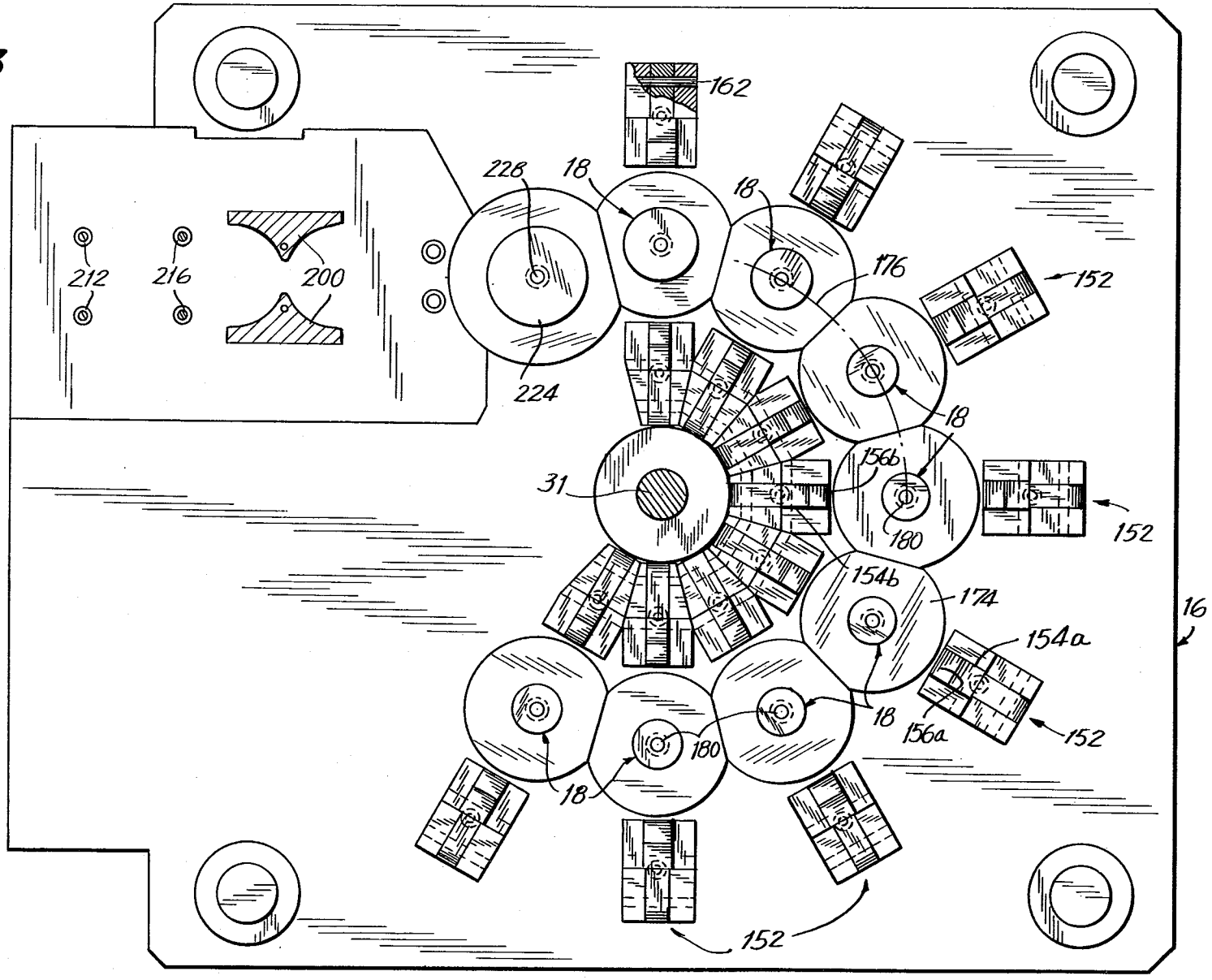
FIG. 3 is a bottom plan view of the upper press platen according to the present invention.

Referring now to the drawings wherein like reference characters designate identical or corresponding parts throughout the several views and more particularly to FIGS. 1–3, the rotary transfer press of the present invention, designated 10, generally comprises a fixed die block 12 having a plurality of successive working stations 14 arranged along a substantially circular path, a vertically reciprocable upper press platen 16 located over the die block having a plurality of cutting and/or forming punches 18 affixed thereto which are aligned with corresponding ones of the working stations 14 and apparatus whereby a plurality of workpieces are simultaneously sequentially transferred along the circular path such that each workpiece is sequentially carried to each of the successive working stations where all corresponding successive forming or cutting operations are simultaneously performed thereon. Thus, each workpiece is either cut or formed in a particular manner at each respective working station in a manner such that as each workpiece is transferred or fed from station to station, it is successively formed until the finished product is obtained, one finished product thus being produced for each stroke of the press.

Generally, in the illustrated preferred embodiment, each of the working stations 14 comprises a die member 20 (see, for example, FIG. 6) into the cavity of which the workpiece is pushed by the punch whereby the workpiece is appropriately drawn. For the sake of clarity, the description below will refer to the workpiece as being drawn in each die. However, it is understood that additional working operations can be performed at each station, such as cutting or otherwise and may also involve work performed above as well as within the die.

Each of the cutting or forming punches 18 (hereinafter referred to as draw punches) is axially aligned with the die member 20 of a corresponding working station 14 in the fixed die block 12 so that the lower end regions of the draw punches 18 enter into and withdraw from the die member cavity of corresponding working stations at substantially the same time during each reciprocating cycle or stroke of the upper press platen 16. More particularly, associated conventional press apparatus (not shown) reciprocates the upper press platen 16 at a predetermined rate so that each stroke of upper press platen 16 includes a downward stroke portion wherein the upper press platen travels from top dead center to bottom dead center and an upward stroke portion where the upper press platen travels from bottom to top dead center.

The apparatus for simultaneously transferring the plurality of workpieces successively to each of the circularly arranged working stations generally comprise a plurality of transfer assemblies 22 arranged along a substantially circular path, each of the transfer assemblies 22 being associated with a respective pair of successive adjacent working stations 14. More particularly, a typical pair of successive adjacent working stations is illustrated in FIG. 1 and comprises a first working station 14*a* and a next successive second working station 14*b*. The second working station 14*b* of each pair of successive adjacent working stations at the same time comprises, however, the first working station of the next pair of successive adjacent working stations. It is therefore apparent that each working station 14 in die block 12 has the dual nature of both the second working station 14*b* of a pair of successive working stations and a first working station 14*a* of the next successive pair of working stations.

As discussed in detail below, each of the transfer assemblies 22 has the function of positively gripping a workpiece at the first working station of the respective pair of successive working stations with which it is associated during the upward stroke portion of the upper press platen 16 subsequent to the drawing operation being performed on the particular workpiece whereupon the transfer assembly advances or transfers the gripped workpiece from the first to the second working station of that respective pair of working stations during the time that the draw punch moves upwardly to top dead center and beings its descent. Upon the transfer of the workpiece to the second working station being completed and with the transfer assembly still gripping the workpiece, the upper press platen or ram which has already begun to descend, carries the draw punch and appropriate apparatus associated with the working station and the draw punch engages the workpiece whereupon the transfer assembly releases the same so that the workpiece is drawn in the second working station of that respective working station pair. During this drawing operation, the transfer assemblies return or retract to the respective first working stations of the working station pairs. Thus, during the retract of the transfer assemblies, the workpieces located in the first and second working stations of each respective working station pair are being drawn by their respective draw punches and it is understood that this operation occurs simultaneously at all of the working stations in the rotary transfer press.

It is apparent from the above that the second working station of the working station pair being discussed constitutes the first working station of the next successive working station pair so that the particular transfer assembly associated with that next successive working station pair is in the process of retracting at the same time. In this manner, when each transfer assembly reaches the first working station of its respective working station pair, the drawing operation has been completed on the workpiece located therein. Appropriate apparatus is located in each of the working stations for locating the workpiece at a position so that the returning transfer assemblies will grip the same whereupon the above-described sequence of operations is repeated.

A blanking station, generally designated 24, comprises the first working station in the rotary transfer press apparatus and, as will be described in greater detail below, sheet stock is fed over a blanking die whereupon a blanking punch descends with the draw punches to blank a new workpiece during each cycle of the press.

Die Apparatus

Figure 2A:
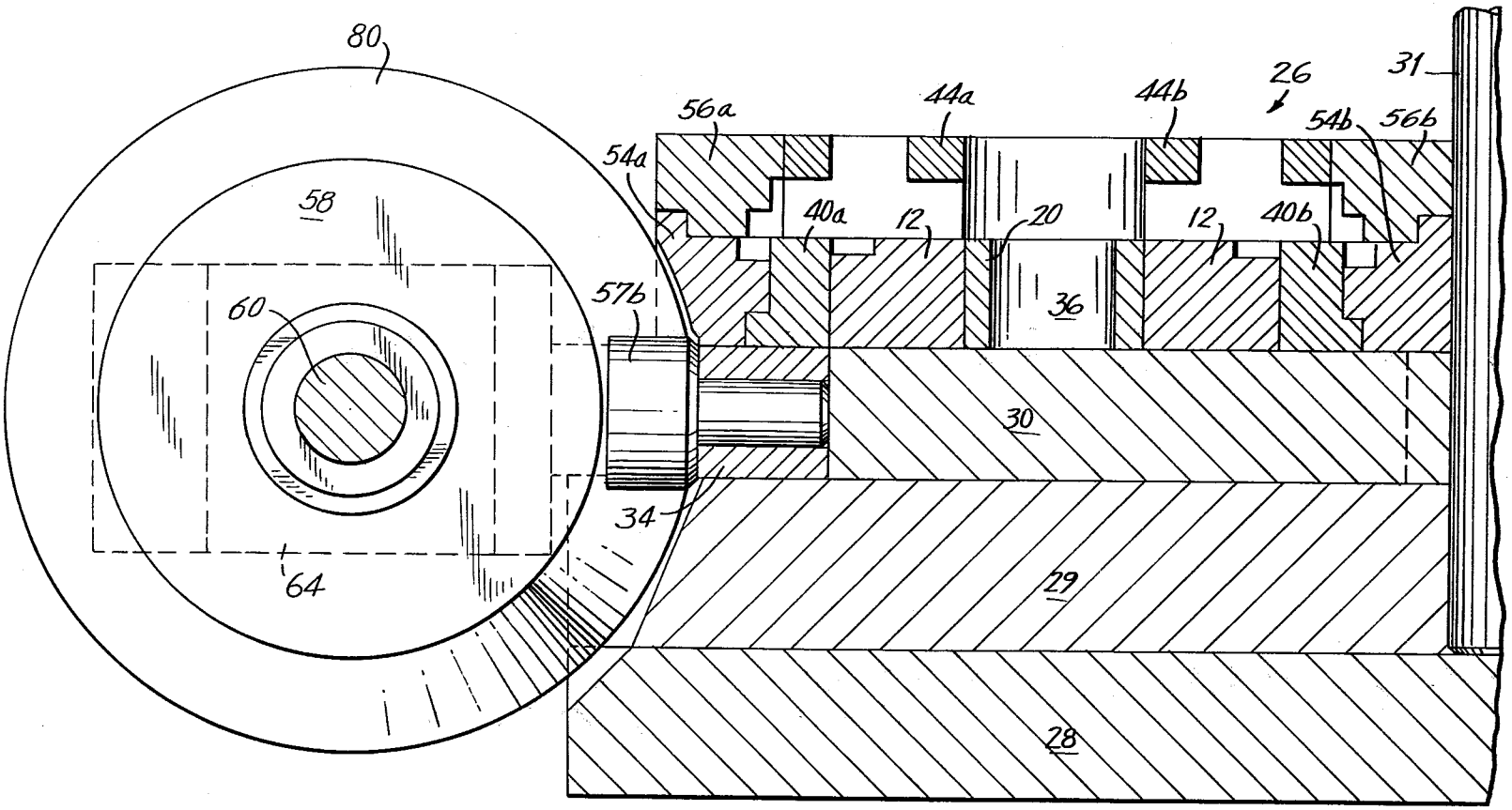
FIG. 2A is a schematic side view of the lower die illustrating the drive apparatus for the workpiece transfer apparatus.

Referring to FIGS. 1, 2, 2A, 6 and 7, the die apparatus, generally designated 26, is mounted on the bolster 28 of the press in the manner illustrated in FIG. 2A. More particularly, a shoe 30 having a circular periphery which is coaxial with a vertically extending central axle 31 is fixed to a sub-shoe 29 by fasteners 32, the sub-shoe being fixed to the bolster 28. Shoe extensions 30*a* are fixed to and extend from bolster 28. An oscillatory ring 34 is mounted over subshoe 29 around the periphery of shoe 30 so that the shoe 30 functions as a central guide for ring 34 during its oscillatory movement. Thus, oscillatory ring 34 is free to rotate around shoe 30 of bolster 28 and axle 31 via apparatus described below.

Figure 7:
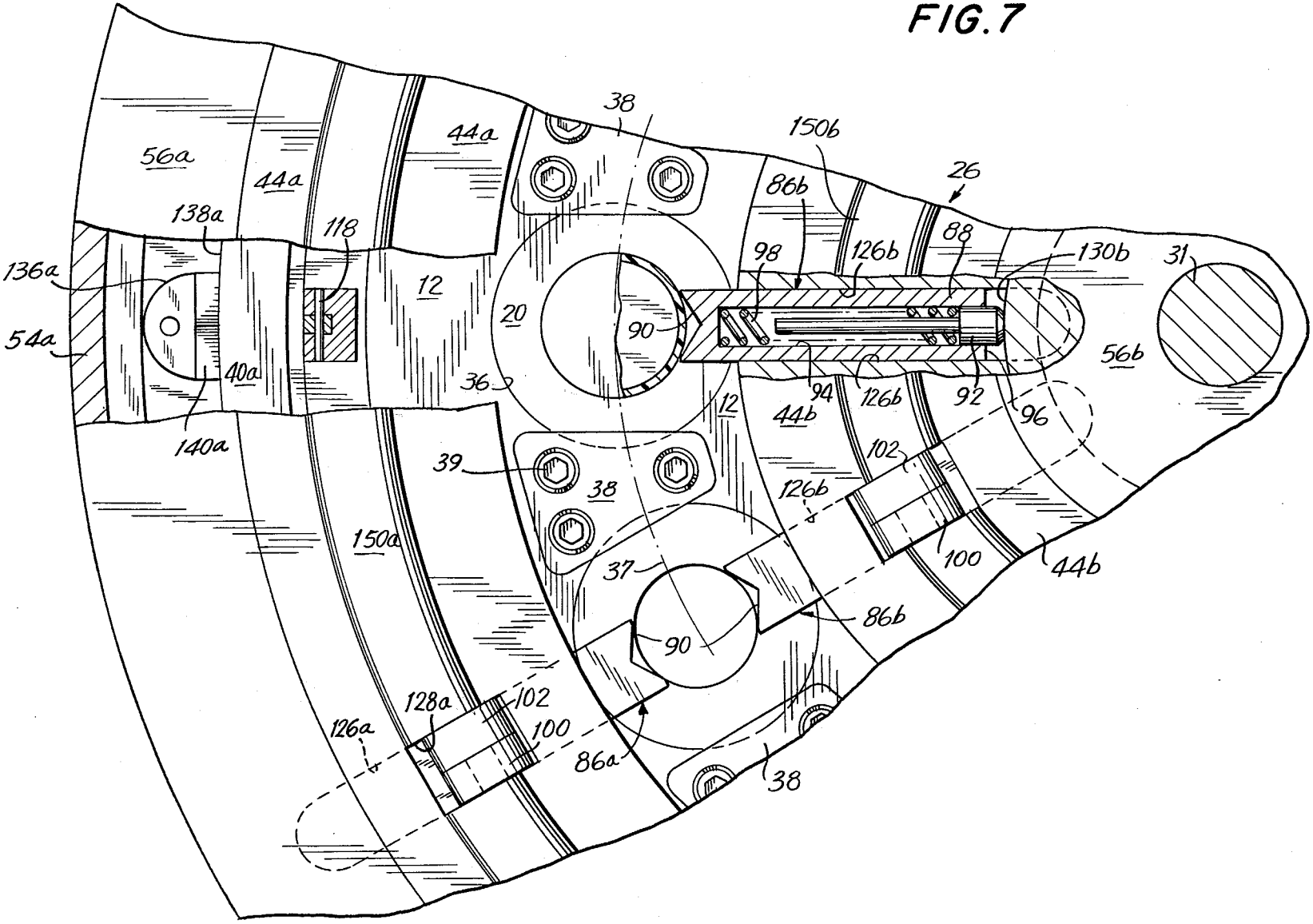
FIG. 7 is a section view taken along line 7—7 of FIG. 6.

The die block 12 is fixed to the shoe 30 by appropriate connectors (not shown). The die members 20 are provided in recesses 36 formed in the fixed die block 12 in a manner such that the die members are circularly arranged, i.e., are located on a substantially common circular center line 37, as best seen in FIGS. 2 and 7. It is understood that the die members 20 vary in shape relative to one another so that as the workpieces are sequentially transferred through the successive die members, corresponding successive forming operations are performed until the finished product is obtained. The die members 20 are retained within die block 12 by means of brackets 38 (FIG. 7), each of which overlies an adjacent pair of die members 20, the brackets 38 being fixed to the upper surface of die block 12 by means of appropriate fasteners 39.

Figure 6:
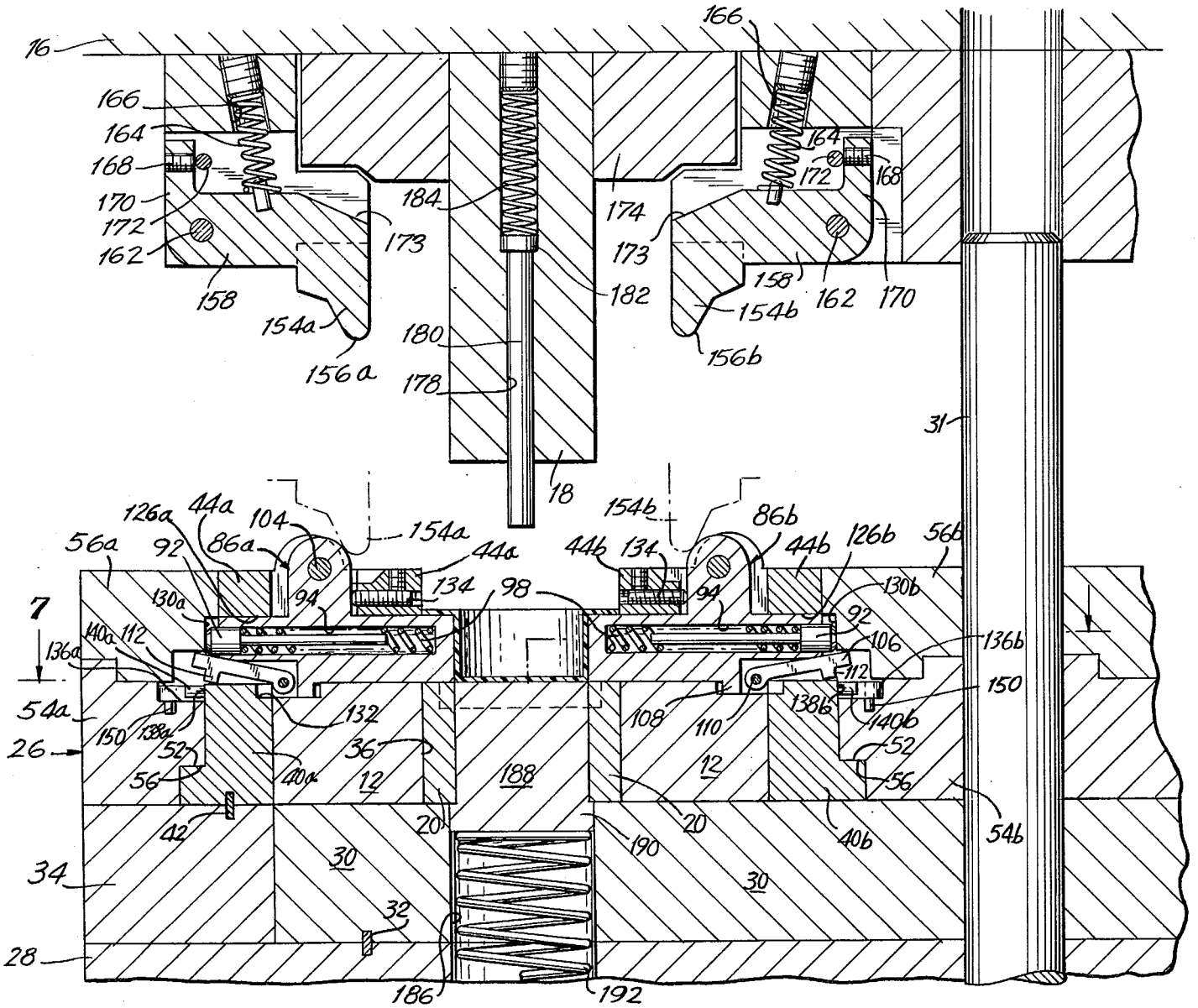
FIG. 6 is a section view taken along line 6—6 of FIG. 4A.

Outer and inner transfer rings 40*a* and 40*b* are freely mounted adjacent to the outer and inner peripheries, respectively, of the fixed die block 12 so as to be oscillatable with respect thereto. The outer transfer ring 40*a* is mounted over the oscillating ring 34 as seen in FIG. 6 and is rigidly connected thereto by appropriate means, schematically illustrated at 42. The inner transfer ring 40*b* is mounted over the shoe 30.

Outer and inner circular finger plates 44*a*, 44*b* are located over the outer and inner transfer rings 40*a*, 40*b*, respectively which serve to carry the transfer fingers comprising the transfer assemblies as discussed in greater detail below. The outer finger plate 44*a* is concentric with and extends outside of the center line 37 of the die members 20 while the inner finger plate 44*b* is similarly concentric with center line 37 but is located inside thereof. The outer finger plate 44*a* is rigidly fastened to the outer transfer ring 40*a* by conventional connectors schematically illustrated in FIG. 1 at 46. A bridge member 48 (FIG. 2) is mutually attached to the upper surfaces of outer and inner finger plates 44*a*, 44*b* by means of connectors 50.

The outer and inner transfer rings 40*a*, 40*b* are formed with outwardly extending shoulders 52 (FIG. 6). The transfer rings are held in position against the outer and inner peripheries of the fixed die block 12 by means of outer and inner hold-down rings 54*a*, 54*b*, respectively, which themselves are formed with shoulders 56 which slideably engage shoulders 52 thereby preventing the transfer rings from moving vertically with respect to the fixed die block 12. The inner hold-down ring 54*b* further functions as the hub for inner transfer ring 40*b*. Additionally, outer and inner upper hold-down rings 56*a*, 56*b* are mounted over and are affixed to the outer and inner hold-down rings, 54*a*, 54*b* and serve to retain the finger plates 44*a*, 44*b*, respectively in position while allowing the latter to oscillate as will be described below.

It will thus be seen that upon the oscillating ring 34 being driven in an oscillating manner via apparatus described immediately below, the outer transfer ring 40*a* will oscillate therewith due to the connection 42 and in turn the outer finger plate 44*a* will also oscillate therewith due to the connection 46 between the outer finger plate 44*a* and outer transfer ring 40*a*. Finally, the inner finger plate 44*b* will oscillate in unison with the outer finger plate 44*a* by means of the bridge member 48 which interconnects the same.

The oscillations of the outer and inner finger plates 44*a*, 44*b* are in precise timed relationship with the cycling of the press, i.e., with the reciprocating movement of the upper press platen or ram 16. More particularly, a pair of roller type followers 57*a*, 57*b* are mounted by stub shafts to the peripheral surface of oscillating ring 34 (FIGS. 2 and 2A) so that their axes of rotation extend radially with respect thereto. A cylindrical cam 58 is mounted on a shaft 60 which itself is rotatably mounted within bearings 62. Bearings 62 are themselves mounted in extensions 64 of the shoe extensions 30*a*. A bevel gear 66 is fixed to an end of shaft 60 which extends through one of the bearings 62 and meshes with a bevel gear 68 affixed to one end of a shaft 70. The other end of shaft 70 has a bevel gear 72 fixed thereto which meshes with a bevel gear 74 which is attached to the end of a drive shaft 76. A drive bevel gear 78 is mounted on the mid-portion of shaft 76 and is adapted to mesh with a bevel gear associated with a drive shaft taken off from the press drive apparatus (not shown). Thus, the cylindrical cam 58 is continually rotated at a constant speed through the rotation of shaft 76 which in turn drives shafts 70 and 60.

The cylindrical cam 58 has a cam surface 80 formed on its surface and the cam surface 80 as well as the location and configuration of cam 58 are such that the cam surface travels through the space defined between the followers 57*a*, 57*b* as seen in FIG. 2. The contour of cam surface 80 is such that two circumferentially extending rectilinear portions 82 (only one shown) are defined at diametrically opposed locations which are interconnected by a pair of helical portions 84 (only one shown). In this manner, as the cylindrical cam 58 rotates at a constant speed, the oscillating ring 34 will be moved first in a clockwise direction (as seen in FIG. 2) as the first helical portion 84 of the cam surface 80 passes between followers 57*a*, 57*b*, whereupon the oscillating ring 34 will dwell for a period as the first straight portion to cam surface 80 passes therebetween whereupon the oscillating ring will move in the clockwise direction as the second helical portion of the cam surface 80 engages the followers and, finally, the oscillating ring 34 will dwell for a second period as the second straight portion of the cam surface 80 engages the followers. Thus, an oscillating movement of the finger plates is achieved with appropriate dwell periods being provided between the advance and retract portions of the oscillations. As seen in FIG. 2A, the bolster 28, sub-shoe 29, oscillating ring 34, and hold down ring 54*a* are contoured in the region of cam 58 so that no interference will occur between them and cam surface 80.

It is understood that the particular oscillatory movement of the finger plates as described above in connection with the illustrated preferred embodiment is only one of many possible movements which can be provided depending upon the configuration of the cam surface 80. The extent of the dwell, advance and retract portions of the oscillations can be suitably varied and, additionally, the advance and retract portions can be reversed by engaging the cam surface 80 between the follower 57*b* and an optional additional follower 57*c*, shown in phantom.

In any event, the following description constitutes a preferred embodiment and the various operations are described in connection with the particular configuration of the cam surface illustrated.

Workpiece Transfer Apparatus

As noted above, apparatus is provided for simultaneously transferring in a circular direction along the path defined by the center line 37 a plurality of workpieces successively to each of the circularly arranged working stations so that each workpiece after being formed at a working station is transferred or advanced to the next successive working station for the next forming operation during each stroke of the press so that a finished workpiece is obtained at the last working station for each stroke of the press.

Figure 8:
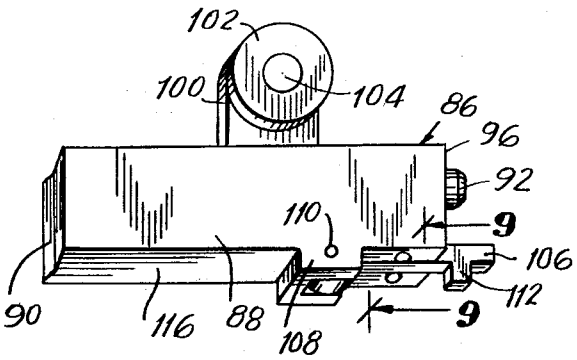
FIG. 8 is a perspective view of the transfer fingers utilized in connection with the present invention.
Figure 9:
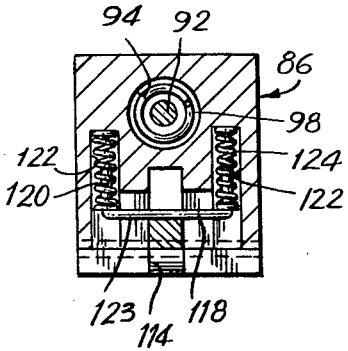
FIG. 9 is a section view taken along line 9—9 of FIG. 8.

Thus, as described above, a plurality of transfer assemblies 22 are arranged along a substantially circular path, each transfer assembly 22 being adapted to advance and retract between a pair of successive working stations to transfer a workpiece from the first to the second working station of the pair. Referring to FIGS. 1, 2 and 6–10, each transfer assembly 22 comprises a pair of transfer fingers 86*a*, 86*b* mounted in the outer and inner finger plates 44*a*, 44*b*, respectively in mutually opposed relationship with respect to each other. More particularly, referring to FIGS. 6–9, each transfer finger 86 comprises an elongated body portion 88 having a clamping end 90 whose shape and size matches the shape and size of the workpiece to be gripped. A plunger 92 is slideably located within an axial bore 94 which opens at the opposite end 96 of body portion 88 and is biased outwardly by means of a spring 98. A lug 100 extends upwardly from the upper surface of body portion 88 and has a rounded upper edge surface. A cam roller 102 having the same radius as the upper surface of lug 100 is pivotally connected to lug 10 by a shaft 104 in a manner such that the upper rounded surface of lug 100 is aligned with the surface of cam roller 102. A latch member 106 has its forward end located within the space defined by a bifurcated downwardly extending shoulder portion 108 and is pivotally attached to the body portion 88 by means of a pin 110. Latch member 106 extends rearwardly beyond the rear end 96 of body portion 88 and a latching portion 112 extends downwardly from latch 106 rearwardly of end 96. A slot 114 is formed in the bottom surface 116 of body portion 88 rearwardly of shoulder portion 108 in which the forward region of latch member 106 is received so that the bottom edge surface of latch member 106 in one position can be flush with the bottom surface 116 of body portion 88 as seen in FIG. 8. The slot extends inwardly into body portion 88 so that the latch member 106 can pivot upwardly therewithin (FIG. 6). A bail 118 has its two upwardly extending legs 120 located within bores 122 formed in the body portion 88 on either side of latch member 106 so that the transversely extending bail leg 123 contacts the upper surface of latch member 106. The bail 118 normally exerts a downward bias on latch member 106 towards the position illustrated in FIG. 8 (the latching position) by means of springs 124 associated with legs 120. In this manner when the latch member 106 is pivoted to its upper position (the unlatched position) as shown in FIG. 6, the bail 118 will exert a downward force thereon.

Referring to FIGS. 1, 2 and 6, each transfer assembly 22 comprises a pair of transfer fingers 86*a*, 86*b* whose respective body portions 88 are axially aligned with each other so as to extend in a radial direction relative to the circular center line 36. The transfer fingers 86*a*, 86*b* of each transfer finger pair are mounted in radially aligned slots 126*a*, 126*b* formed in the outer and inner transfer finger plates 44*a*, 44*b*, respectively in a manner such that the clamping ends 90 of the transfer fingers 86*a*, *b* are in spaced, opposed relationship. Further, openings 128*a*, 128*b* are formed in finger plates 44*a*, 44*b* (FIG. 7), respectively, which open into slots 126*a*, 126*b* and the upper surfaces of the respective finger plates. The openings 128 (FIG. 7) receive the lug 100 and associated cam roller 102 of each respective transfer finger therein and the length of the opening 128 in the radial direction is somewhat greater than the diameter of the cam roller 102 so that sufficient clearance is provided for the radial movement of the transfer fingers within the slots 126.

Referring to FIGS. 6 and 7, the area in which each transfer finger is located is defined at its upper region by slot 126, at its rearward region by a wall section 130*a*, 130*b* of the respective inner and outer upper hold-down rings 56*a*, 56*b* and at its lower region by the upper surface of the die block 12 at respective inner and outer transfer rings 40*a*, 40*b*. It is noted that the adjoining regions of the upper surfaces of the outer and inner transfer rings 40*a*, 40*b* and die block 12 have mating recesses 132 formed therein in which the shoulder portion 108 of each respective transfer finger rides. The forward end regions of the outer and inner transfer fingers 86*a*, 86*b* extend inwardly beyond the opposed vertical surfaces of the respective finger plates 44*a*, 44*b* and over the die block 12. The transfer fingers 86*a*, 86*b* of each transfer finger pair are normally biased inwardly, i.e., towards each other, to a closed position through the engagement of wall sections 130*a*, 130*b* by the spring biased plungers 92. The inward or closing movement of the transfer fingers of each pair is selectively limited by means of set screws 134 (FIG. 6) provided in the respective finger plates and which extend into the respective openings 128 to engage the forward surface of lugs 100 to prevent further closing movement of the respective transfer fingers.

Circularly extending channels or recesses 136*a*, 136*b* are formed in the upper surfaces of the respective hold-down rings 54*a*, 54*b*, adjacent to the contiguous outer walls of transfer rings 40*a*, 40*b* so that the upper portion of the walls of the transfer rings comprise vertical ledges 138*a*, 138*b*.

As will be described in greater detail in connection with the description of the operation of the invention, when the transfer fingers are in their inner or closed position as seen in FIG. 6, the latching portions 112 of the latch members 106 engage the upper surfaces of the respective transfer rings 40*a*, 40*b* so that the latch members are pivoted upwardly within the slot 114 formed in the body portion 88 of the transfer finger. Upon the transfer fingers being moved outwardly, i.e., away from each other, to their open position, the latch members 106 are pivoted downwardly by bails 118 (FIG. 9) so that the latching portions 112 engage the respective ledges 138*a*, 138*b* so that the transfer fingers are held in their open position against the force of the spring biased plungers 92.

Each working station 14 has associated therewith outer and inner ramp members 140*a*, 140*b*, respectively which are substantially radially aligned with each other with respect to center line 36. More particularly, referring to FIG. 10 each ramp member 140 includes a ramp portion 142 and an integral connecting portion 144. The ramp portion 142 is defined by a pair of obliquely extending ramp surfaces 146*a*, 146*b* which, as discussed below, need not be symmetrically formed with respect to each other. The connecting portion 144 has a bore 148 formed therethrough through which a suitable connecting member can pass.

Referring to FIGS. 6, and 7, a pair of ramp members 140*a*, 140*b* are fixed within channels 136*a*, 136*b*, respectively at radially opposed locations with respect to a respective working station 14 by means of a connector 150 which passes through bore 148 and which connects the respective ramp member to outer and inner hold-down rings 54*a*, 54*b*. The ramp members are located so that the ramp portions 142 thereof are contiguous with the ledges 138*a*, 138*b* defined by the respective transfer rings 40*a*, 40*b*.

Figure 10:
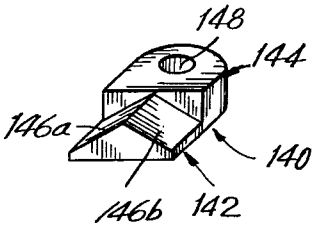
FIG. 10 is a front view of a ramp member constituting a part of the transfer apparatus according to the present invention.

For purposes which will be made clearer during the description of the operation of the invention, the ramp members 140*a* located in the outer channel 136*a* has a greater circumferential extent than does the ramp members 140*b* located in the inner channel 136*b*, so that although the inner and outer ramp members have the same general configuration shown in FIG. 10, they differ to the extent described above.

Figure 11:
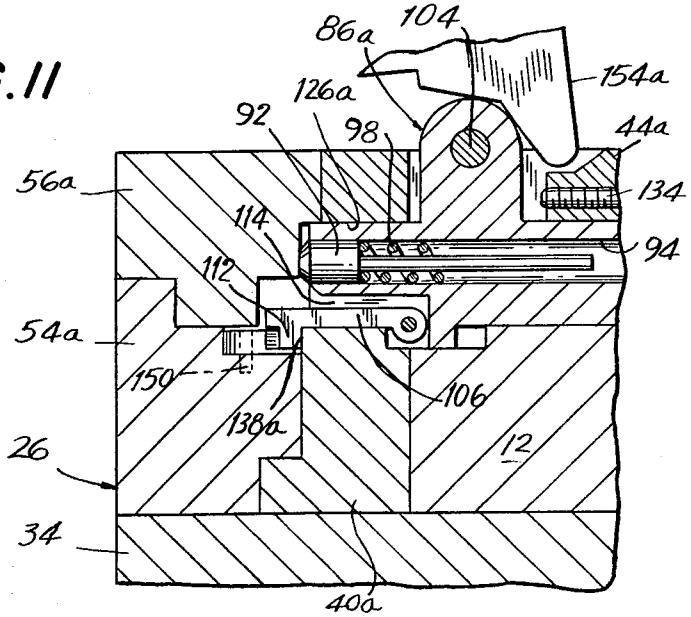
FIG. 11 is a section view taken along line 11—11 of FIG. 4C.

As will be described in greater detail in connection with the description of the operation of the invention, when the transfer fingers are in their open position with latching portions 112 of latch members 106 engaged with the respective ledges 138 such as shown in FIG. 11, upon the interconnected finger plates 44*a*, 44*b* being rotated to a position wherein the transfer fingers are radially aligned with the working station, the latching portion 112 of each latch member 106 will engage a ramp surface 146 thereby causing the latch member 106 to pivot upwardly to disengage the latching portion 112 from its respective ledge 138 whereupon the transfer fingers will move inwardly to their closed position under the force of the spring biased plunger 92 which is in engagement with the wall section 130 of the upper hold-down rings 56*a*, 56*b*.

Each of the finger plates 44*a*, 44*b* has formed on its upper surface a circularly extending shoulder 150*a*, 150*b* (FIG. 1) respectively. Shoulders 150*a*, 150*b* have a semi-circular cross-section having a radius substantially the same as the upper edge surface of lugs 100 and cam rollers 102. As best seen in FIG. 1, the shoulders 150*a*, 150*b* extend in alignment with the openings 128*a*, 128*b*, respectively, and, more particularly, with the outer portions thereof. In this manner, when the transfer fingers are moved to their outer or open position, the lugs 100 and associated cam rollers 102 become substantially aligned with the respective shoulders. However, when the transfer fingers are in their inward or closed positions as shown in FIG. 7, the lugs and associated cam rollers are displaced inwardly with respect to the corresponding shoulders.

The opening action of the transfer fingers is accomplished by means of cam assemblies, generally designated 152, fixed to the upper press platen 16. Thus, referring to FIGS. 1, 3 and 6, each working station 14 has associated therewith a cam assembly 152, each cam assembly including an outer cam member 154*a* and an inner cam member 154*b* having respective cam surfaces 156*a*, 156*b*.

The cam chambers 154*a*, 154*b* of each cam assembly 152 are mounted so as to be vertically aligned over the inner portion of the shoulders 150*a*, 150*b*, respectively, and radially aligned relative to the center line 36. Thus, each cam member 154 comprises a body portion 158 (FIG. 6) which is pivotally connected within a slot defined within a respective cam housing 160 by means of a pin 162. A spring 164, one of whose ends is pinned to the upper surface of the body portion 158 and whose upper surface is fixed within a bore 166 of cam housing 160, normally maintains each cam member 154 in the position illustrated in FIG. 6. Each cam member 154 is prevented from pivoting downwardly through the engagement of a set screw 168 provided within an upwardly extending portion 170 of the cam member 154 with a laterally extending pin 172 whose ends are secured in the cam housing 160. In this manner, slight adjustments in the orientation of the cam surfaces 156 can be made through the adjustment of set screw 168.

As seen in FIGS. 1, 3 and 6, the cam members 154*a*, 154*b* of each cam assembly 152 is located on diammetrically opposed sides of a respective punch 18 so that the cam assemblies 152 extend in a circular path. Sufficient clearance is maintained between the upper surface 173 of each cam member 154 and the punch holder 174 which fixes the respective punch 18 to the upper press platen 16 so as to allow for an unimpeded pivoting of the cam member during the operation of the assembly as described in greater detail below.

Although the inner and outer cam members 154*a*, 154*b* are substantially identical, for purposes which will be made clearer in the description of the operation of the apparatus, the cam surface 156*a* of outer cam member 154*a* has a wider circumferential extent that that of cam surface 156*b*of inner cam member 154*b*.

The operation of the workpiece transfer apparatus described above will become more apparent during the description of the operation of the apparatus. Briefly, upon the transfer fingers being advanced to the second working station of each pair of successive working stations, the cam rollers 102 of the outer and inner transfer fingers 86*a*,86*b* are located immediately vertically below the cam surfaces 156*a*, 156*b*, respectively of an associated cam assembly 152 so that upon the press platen descending, the cam surfaces 156 will engage the respective cam rollers 102 and by virtue of the obliquely extending surfaces thereof, will urge the transfer fingers outwardly to their open position. A more detailed description of this operation is set forth below.

It should also be noted by virtue of the unique construction of the lower die as described above, it is seen that it is a simple matter to replace the die block as desired with, for example, a more complex die block. Thus, by merely removing the hold-down rings and lifting the workpiece transfer apparatus from the lower die, access is provided to the die block which can then be changed or repaired.

Punch and Workpiece Holding Apparatus

Referring to FIGS. 1, 3 and 6, a plurality of punches 18 are affixed to the upper press platen 16 by means of respective punch holders 174, each punch 18 being directly vertically aligned over a corresponding die member 20. It is thus understood that the punches 18 are circularly arranged on the upper press platen around a center line 176 (FIG. 3) which coincides with center line 36. As best seen in FIG. 3, each punch 18 has a slightly different configuration from that of the immediately preceding punch so that successive working operations are performed in each successive working station. It is understood that with each stroke of the press, the lower end region of each punch 18 enters into the respective die member 20 so that all of the workpieces located at the respective working stations have a forming operation performed thereon simultaneously.

Each of the punches 18 has an axial bore 178 (FIG. 6) formed therein having a stepped diameter, the reduced diameter portion thereof opening at the lower or working end of the punch. A pin 180 is slideably located with bore 178 having a shoulder 182 which fixes the lowermost position of the pin 180 upon engagement with the shoulder of bore 178 defined by the stepped diameter. A spring 184 extends within the enlarged diameter portion of bore 178 one end of which bears against the shoulder 182 normally biasing pin 180 in its downward position as seen in FIG. 6.

Still referring to FIG. 6, a bore 186 is formed in shoe 30 coaxial with the die member 20 at each of the working stations 14. A pad 188 is slideably located within each die member 20 having a cross-section which conforms to the shape of the particular die in which it is located. An enlarged diameter lower portion 190 of pad 188 rides within bore 186. The pad 188 is urged into the die cavity of the respective die member 20 by means of a coil spring 192 located within bore 186 and the axial length of the pad 188 is such that the upper surface thereof preferably is flush with the top of the die block 12 as seen in FIG. 6.

The provision of the spring pin 180 and pad 188 as described above insures that the workpiece will at all times be positively supported during its travel through the successive working stations. More particularly and as described in greater detail below in connection of the operation of the apparatus, after a particular workpiece is advanced to a working station, the upper press platen descends. The transfer fingers which grip the workpiece are moved outwardly through the engagement of the cam members 154 with the respective cam rollers 102 prior to the working end of the punch engaging the workpiece. However, prior to the transfer fingers being moved outwardly, the lower end of the spring pin 180 engages the workpiece so that the latter is positively gripped between the spring pin 180 and the pad 188. As the upper press platen continues to descend, the spring pin 180 is urged inwardly within bore 178 against the force of spring 184 during which time the transfer fingers are opened and as the punch continues to descend, the workpiece is urged into the cavity of the die member 20 with the pad 188 being moved downwardly into bore 186 during the forming operation. Further, as the punch 18 begins its ascent the pad 188 urges the workpiece out of the die cavity until the pad 188 reaches its uppermost position whereupon the pin 180 is urged outwardly under the force of spring 184 thereby stripping the workpiece from the punch 18.

Blanking Station

Figure 14:
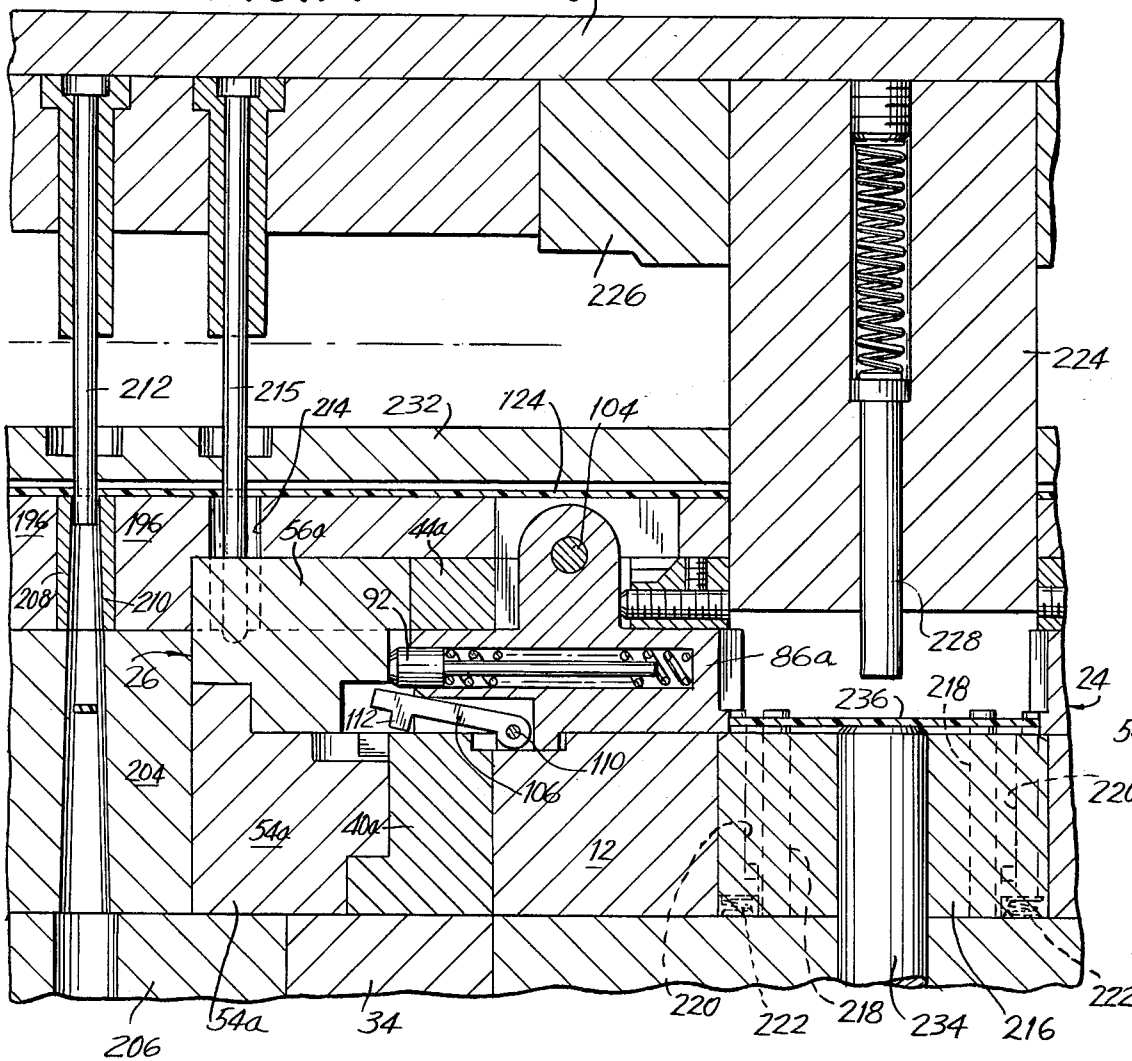
FIG. 14 is a section view taken along line 14—14 of FIG. 2 illustrating a blanking station according to the illustrated embodiment of the present invention.

Referring to FIGS. 2, 3 and 14, the workpiece is initially blanked from sheet metal stock 194 at a blanking station, generally designated 24, which comprises the first working station in the die block 12 together with cooperating blanking apparatus. More particularly, a progressive die block 196 is located over the die apparatus 26 over which the sheet metal stock 124 is intermittently fed in timed relation with the stroke of the press. Die openings 198, each having a double arcuate configuration are provided on the die block 196 which cooperate with trims 200 (FIG. 3) provided on the upper press platen 16 as described above to cut the sheet stock 124 into a series of interconnected circularly shaped portions 202. The die block 196 is fixed to the upper surface of a riser block 204 which itself is fixed to the top surface of a shoe extension 206. Die block 196 has a pair of laterally aligned inserts 208 formed therein which define upwardly tapering bores 210 for receiving the lower ends of piercer members 212 fixed to the upper press platen 16 and a second pair of bores 214 formed forwardly of the bores 210 in the direction of feed of the stock material a distance equal to the pitch of the feed, the bores 214 adapted to receive the lower ends of pilot members 216 which are similarly affixed to the upper press platen.

The blanking station 24, unlike the other working stations, does not have a die member provided within the die block 12 but, rather, a solid insert 216 is located therein whose upper surface is flush with the upper surface of die block 12. A pair of fixed pins 218 (FIGS. 2 and 14) extend upwardly through insert 216 so that their upper portions extend beyond the upper surface thereof contiguous with the periphery thereof. A second pair of pins 220 are located within bores formed in insert 216 and are normally biased upwardly by associated springs 222 so that their upper end regions extend beyond the upper surface of insert 216. The movable pins 220 are also located along the periphery of the working station but forwardly in the direction of advance of the transfer assemblies 22 as will be described below. As will be described in greater detail below, the fixed and movable pins 218, 220 serve to hold the blank after it is punched from the sheet stock 124 prior to the blank being advanced to the next working station.

A blanking punch 224 is affixed to the upper press platen 16 by means of punch holder 226 and is axially aligned with the blanking station 24. The blanking punch 224 has a spring pin 228 similar to the pin 180 in punches 18. As mentioned above, a pair of piercer members 212 are fixed within punch holder 226 to upper press platen 16 and a pair of pilot members 215 are similarly fixed to the upper press platen forwardly of the piercer members 212. Finally, a pair of spring pins 230 (FIG. 3) are affixed to the upper press platen and serve to hold the sheet metal stock against the die block 196 adjacent to the blanking station 24.

A stripper member 232 (FIG. 14) is preferably provided over the sheet metal stock 124 to prevent the latter from lifting from the die block 196 during the ascent portion of the stroke of the blanking punch 224.

Operation

Figure 5:
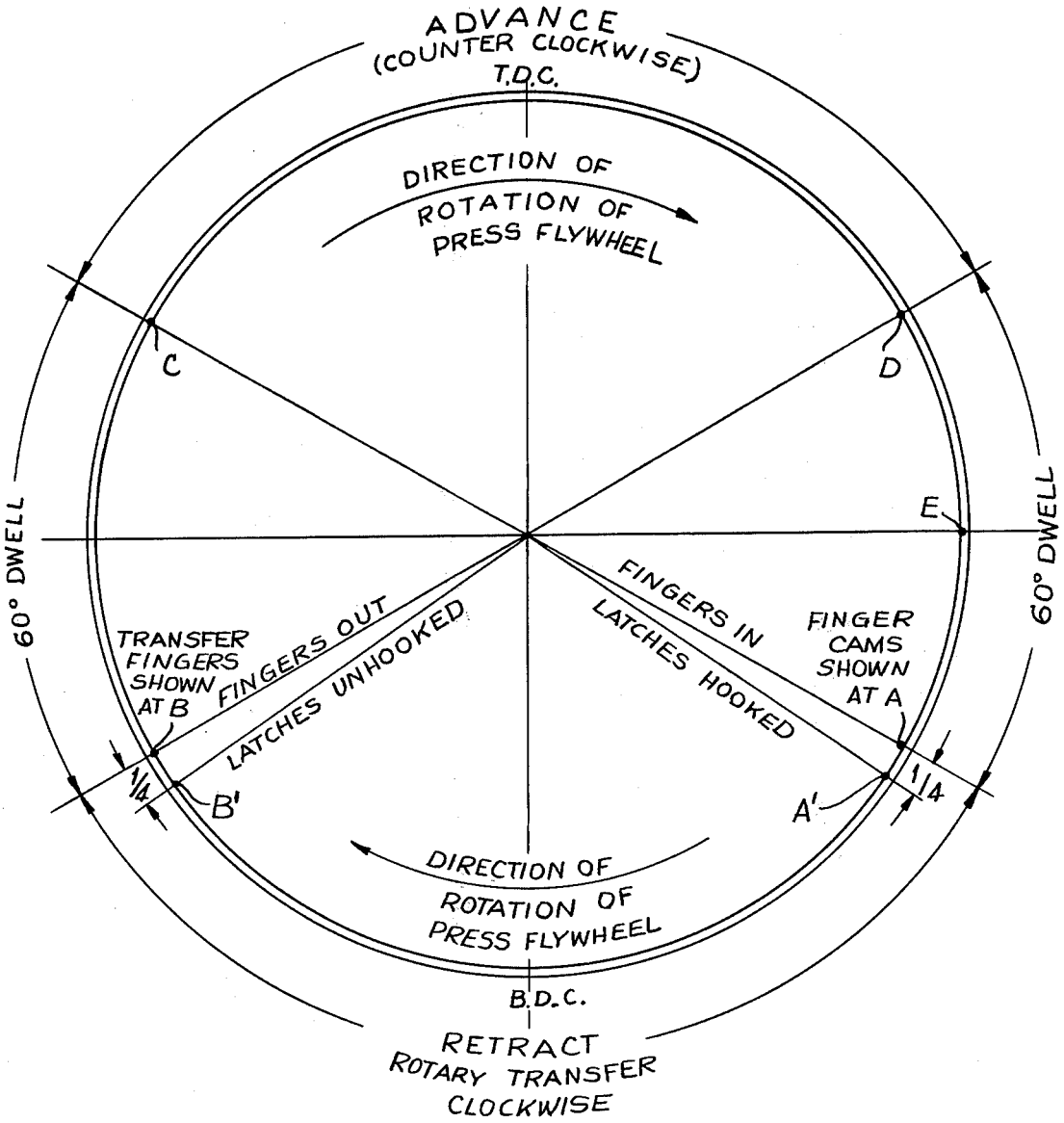
FIG. 5 is a cycle diagram illustrating the timing of the transfer apparatus of the present invention in relationship to the movement of the draw punches during a complete press cycle according to the illustrated embodiment of the present invention.

The operation of the apparatus will now be described in conjunction with the cycle diagram illustrated in FIG. 5. The diagram illustrated in FIG. 5 represents the rotation of the press fly wheel (clockwise) so that the position of the working end of the punches at any time is represented by the horizontal projection of a point on the perimeter of the diagram onto the vertical diameter thereof. Thus, TDC represents the top dead center condition and B.D.C. represents bottom dead center. Point E on the cycle represents the condition where the punch is mdiway between top and bottom dead center. The operation of the transfer assemblies relative to the location of the punches is indicated by the legends on the outer periphery of the cycle.

The operation of the apparatus will be described assuming that the same has been in steady state operation for sometime so that all of the working stations have workpieces associated therewith.

Figure 4A:
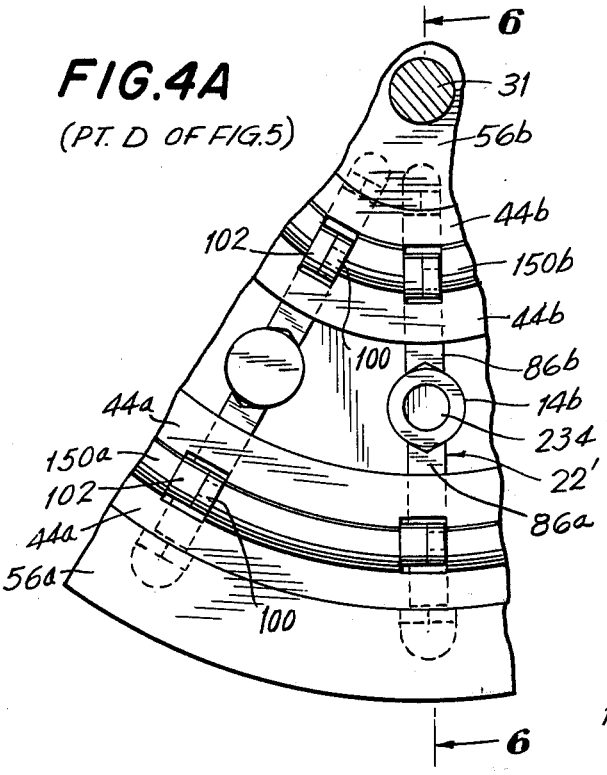

FIGS. 4A–4G illustrate in a schematic manner the operation of the transfer apparatus between a pair of successive adjacent working stations. Referring to FIG. 4A, first and second working stations **14*a*, 14*b* of a pair of successive adjacent working stations are illustrated. FIG. 4A represents the condition designated by point D on the cycle diagram of FIG. 5. Thus, as indicated in FIG. 5, the transfer assemblies 22 have just completed their advance movement and are initiating a dwell period for 60° of rotation of the press fly wheel, i.e., between the time the punches move from the vertical position designated point D to point A. Referring to FIG. 4A, the transfer assembly designated 22' is associated with the pair of working stations 14*a*, 14*b*, i.e., transfers workpieces from the first working station 14*a* to the second working station 14*b* and then returns to the first working station 14*a*. The transfer assembly designated 22'' is associated with the next previous pair of working stations of which the working station 14*a* constitutes the second one. Referring to FIG. 4A in conjunction with FIG. 6, the transfer fingers 86*a*, 86*b* are in their closed configuration and are positively grasping a workpiece 234 therebetween under the urging of the springs 98 disposed within the transfer fingers. As seen in FIG. 6, the latch members 106 are in their upper or unlocked position and the transfer fingers are in their innermost position with the lugs 100 abutting against the set screws 134 provided in the finger plates 44*a*, 44*b*. The punch 18 is descending along with the cam members 154*a*, 154*b***.

By virtue of the straight portion 82 of the cam surface 80 of cylindrical cam 58, as the punch moves downwardly to point E (and eventually to point A) on the cycle diagram, the transfer assemblies 22 dwell and continue to hold the workpieces at the working stations.

In connection with the blanking operation, it is noted that the blank which had been punched during the previous press cycle had been advanced to the next working station thereby leaving the blanking station 24 empty. The blanking punch 224 is appropriately formed so that a blank is punched from the sheet stock material 124 at point E on the cycle diagram. In this connection, referring to FIG. 14, a plunger 234 connected to a suitable hydraulic or pneumatic control, is in a raised position (not shown) wherein its upper surface is located flush with the surface of the die block 196. As the blanking punch 224 descends, the tip of the spring pin 228 first contacts the sheet stock 124 until the punch 224 descends to point E whereupon the blank is cut. As the blanking punch 224 moves from point E to bottom dead center, the blank, designated 236 is carried between the punch and the plunger 234 whereupon it is gripped between the fixed and movable pins 218, 220 and held therebetween until it is advanced to the next working station as described below.

Figure 4B:
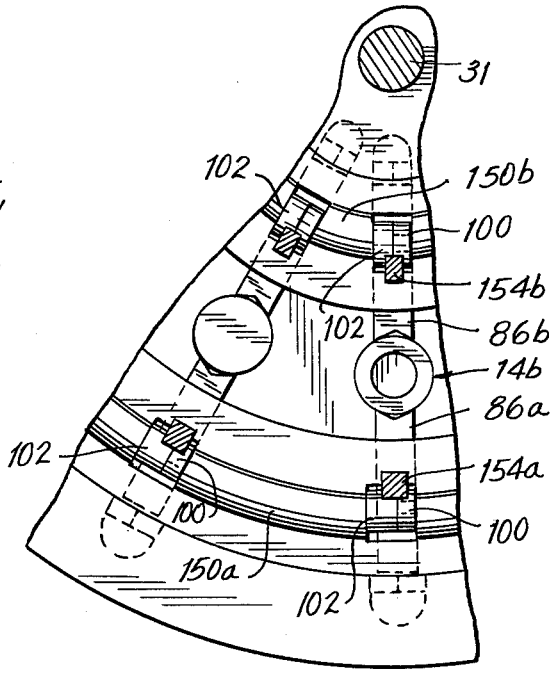

The punches 18 continue to descend until reaching the point designated A on the cycle diagram. At this point, several things occur. Thus, the cam surfaces 156 of cam members 154*a*, 154*b* initiate contact with the cam rollers 102 and lugs 100 of the transfer fingers 86*a*, 86*b*. This condition is shown in FIG. 4B and the position of the cam members 154 is illustrated in phantom in FIG. 6. Simultaneous with the engagement of the cam members 154 with the transfer fingers as described above, the dwell period of the transfer assemblies terminates and the retract portion begins. Thus, the cylindrical cam 58 has rotated to the point where the helical portion 84 of the cam surface 80 passes between the roller followers 56.

Figure 4C:
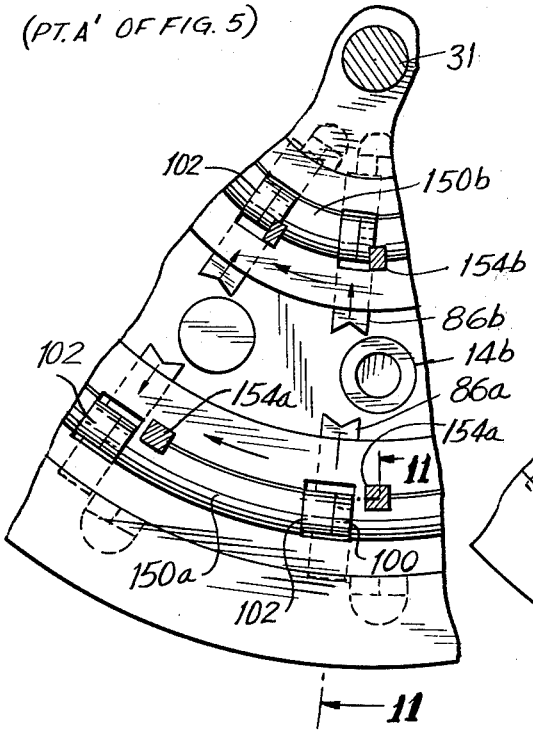

The configuration of the apparatus at point A on the cycle diagram is illustrated in FIG. 4C. The descent of the upper press platen whereby the punches descent from point A to point A′ of course is accompanied by further downward movement of the cam members 154 and this continued downward movement results in the cam surfaces 156*a*, 156*b* urging the transfer fingers 86*a*, 86*b* respectively, with whose cam rollers they engage, outwardly against the force of springs 98. As mentioned above, at the same time, the finger plates are retracting or moving in a clockwise direction as seen in FIG. 4C whereby the lugs 100 are gradually disengaging from the cam members 154*a*, 154*b*. However, the transfer fingers 86*a*, 86*b* are opened sufficient through engagement with cam members 154 that the latching portions 112 of latch members 106 extend beyond the ledges 138*a*, 138*b* so that the latch members 106 pivot downwardly as seen in FIG. 11 thereby locking the respective transfer fingers in their opened configuration against the force of springs 98. It should be noted that it is necessary for the transfer fingers to retract clockwise at least to some extent so that upon the transfer fingers being moved outwardly, the ramp members will not prevent the latch members from pivoting downwardly.

Still further, the working end of the punch 18 reaches the level of the die block at point A thereby engaging the workpiece at this time. Of course, the lower end of the spring pin 180 engages the workpiece a short time prior to the punch reaching point A so that the workpiece is positively engaged between the spring pin 180 and the pad 188 prior to the time that the transfer fingers begin to open through engagement by the cam members 154. Thus, as the punches descend from point A to point A′, the workpiece is being urged downwardly into the die member 20, the transfer fingers are opening and beginning their retract movement towards the first working stations of each respective working station pair, their opening movement resulting in a locking in their opened position by the time the punches reach the point designated A′.

Figure 4D:
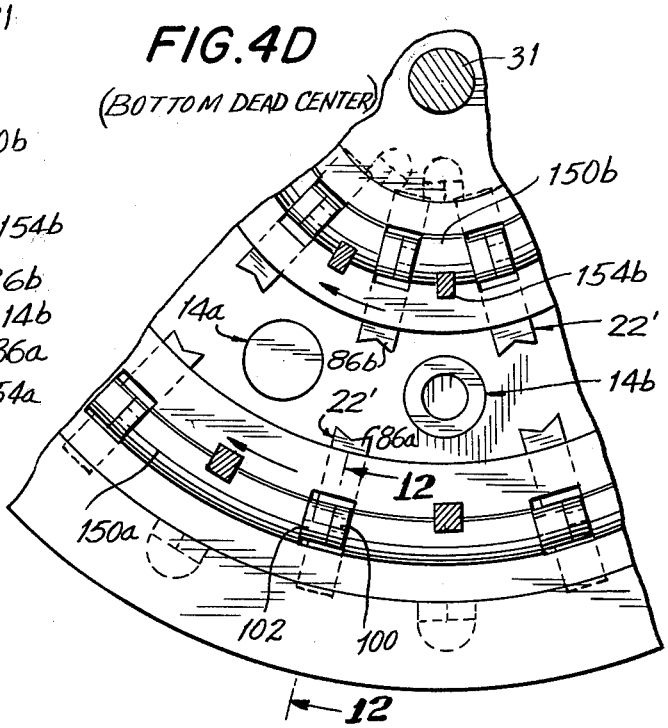
Figure 12:
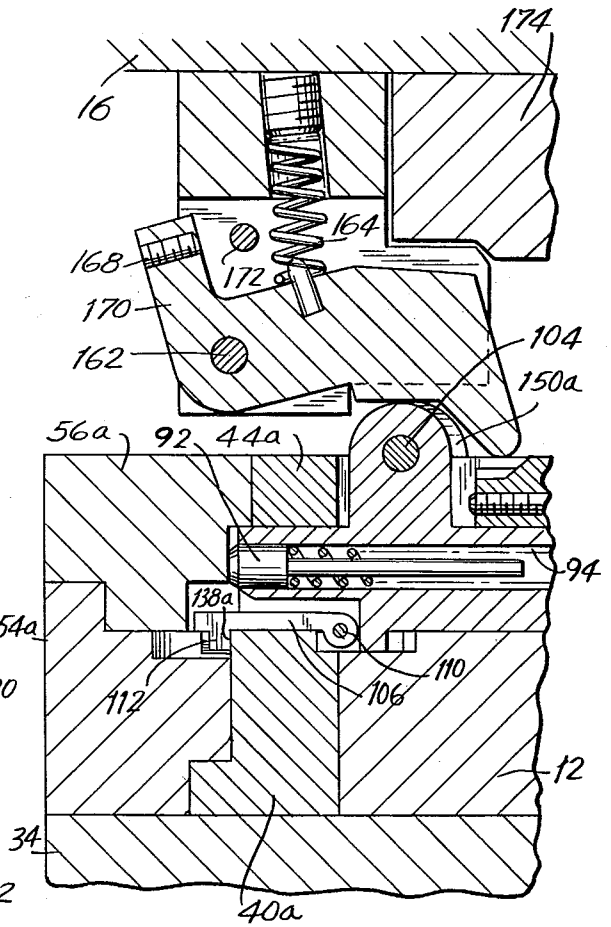
FIG. 12 is a section view taken along line 12—12 of FIG. 4D.

The punches continue to descend until they reach their bottom dead center position illustrated in FIG. 4D. At this point, the forming of the workpiece in each working station has been completed and the respective punches are beginning their ascent stroke portion. According to the particular configuration of the cam surface of the cylindrical cam 58, the transfer assemblies 22 are at their precise midpoint of the retract movement. Thus, referring to FIG. 4D, the transfer assembly 22′ associated with the first and second working stations 14*a*, 14*b* is at the midpoint of its retract movement and is moving in the direction of arrow 238. During this retract portion, the transfer fingers 86*a*, 86*b* are maintained in their open configuration by the continued engagement of the latching portion 112 of latch member 106 with the ledges 138. Further, referring to FIGS. 4C and 4D in conjunction with FIGS. 11 and 12, it is seen that as the punches continue to descend until the bottom dead center position is reached, the cam members 154 will ride on the shoulders 150*a*, 150*b* and pivot against the force of springs 164 thereby allowing the continued descent of the punches. FIG. 11 illustrates the condition wherein the transfer fingers have been moved so that they have just locked into their open position and the pivoting of the cam members 154 have just begun. FIG. 12 illustrates the bottom dead center condition wherein the cam members 154 have pivoted to their maximum extent. Of course, it is understood that during this time, the shoulders 150 are slideably engaging cam members 154 as the respective finger plates retract.

It is apparent from FIG. 4D, that while the transfer assembly 22′ is retracting from the second working station 14*b* to the first working station 14*a*, the previous transfer assembly 22″ is similarly retracting and, additionally, the next subsequent transfer assembly 22‴ is retracting towards the second working station 14*b* (which comprises the first working station of a next subsequent pair of working stations).

The transfer assemblies continue to retract with continued upward movement of the punches whereupon the point designated B′ on the cycle diagram is reached. At this point, the latching portions 112 of latches 106 on each of the transfer fingers 86*a*, 86*b* engage a ramp surface 146 of a respective ramp member 140*a*, 140*b* whereupon the latch members 106 are pivoted upwardly thereby unlocking the transfer fingers. However, the transfer fingers are prevented from immediately moving inwardly by the engagement of the cam rollers 102 by the cam surfaces 156 of cam members 154 which are themselves moving vertically upwardly with the punches at this time. It is noted that this engagement between the cam surfaces 156 of cam members 154 and the cam rollers 102 is greatly facilitated by the fact that the outer configuration of the annular shoulders 150 correspond to that of the cam rollers 102 when the latter are in their outer location, i.e., when the transfers are locked in their open position. In other words, the outer surfaces of the annular shoulders 150 and the cam rollers 102 present a continuous surface so that the cam members 154 can slide directly onto the cam rollers 102 as the finger plates continue to retract. Thus, when the transfer fingers are unlocked by engagement of the latch members with the ramp members, they are prevented from snapping inwardly immediately through the engagement by the upwardly moving cam members 154.

In this connection, it is noted that in view of the circular configuration of the apparatus of the present invention, it is desirable to extend the ramp members 140*a* located in the outer channels 136*a* a greater circumferential distance within channel 136*a* than is necessary in the case of the ramp members 140*b* located within the inner channel 136*b*. Similarly, in order to assure that the outer cam members 154*a* engage the cam rollers of the outer transfer fingers 86*a* at the time that the latter are unlatched so as to prevent their snapping inwardly, it is desirable to extend the width of the outer cam members 154*a* to a greater circumferential extent than in the case of the inner cam members 154*b*. In this manner, a simultaneous unlocking of the transfer fingers can be accomplished with a simultaneous engagement of the cam rollers of the inner and outer transfer fingers with their respective cam members.

As the upper press platen continues to ascend, the cam members 154 move upwardly thereby allowing the transfer fingers to move inwardly to their closed position under the force of springs 98. Thus, the upward movement from point B' to point B as designated on the cycle diagram results in the gradual disengagement of the cam members 154*a*, 154*b* from the cam rollers 102 of transfer fingers 86*a*, 86*b* respectively. Simultaneously, the retract movement of the finger plates is completed. Of course, while this occurs, the workpiece which has been formed in the first working station 14*a* has been elevated by pad 188 to a location over die block 12 such that upon the retract movement of the transfer fingers being completed, the workpiece is in a position wherein it it readily gripped by the inwardly moving transfer fingers as schematically illustrated in FIG. 4F. Thus, FIG. 4F represents the point B on the cycle diagram wherein the retract movement of the transfer assemblies has been completed.

The punches continue to move upwardly and during their upward movement between points B and C as indicated on the cycle diagram, the transfer assemblies dwell under the action of the configuration of the cam surface of the cylindrical cam 54.

The advance movement of the transfer assemblies begins as the punches ascend beyond point C on the cycle diagram. Thus, the second helical portion of the cam surface 80 now operates between followers 56*a*, 56*b* thereby initiating the counterclockwise movement of the finger plates 44*a*, 44*b* and their associated transfer fingers. Thus, the transfer assemblies which have gripped respective workpieces at the first working stations of each respective pair of working stations now undergo an advance movement while carrying the gripped workpieces towards the second working station of each respective working station pair. In the illustrated preferred embodiment this advance movement is at its midpoint when the upper press platen is at its top dead center location and this condition is illustrated schematically in FIG. 4G. Thus, the transfer assembly 22' when carrying the workpiece at the first working station 14*a* is advancing in the counterclockwise direction as indicated by the arrows towards the second working station 14*b*. The advance movement is completed when the punch descends to point D illustrated in FIGS. 4A and 6 whereupon the upper press platen continues to descend to thereby open the transfer fingers as described above.

At the blanking station, the blank 236 is gripped by a pair of transfer fingers which has completed its retract movement from the next subsequent working station in the same manner as described above in connection with a typical pair of adjacent working stations. When the advance movement of the transfer assemblies is initiated, the transfer fingers 86*a*, 86*b* contact the upper regions of the moveable pins 220 thereby urging them downwardly allowing the blank to be moved out of the blanking station towards the next working station.

It should be noted that it is not necessary to provide finger cams on the upper press platen over the blanking station since no workpiece is transferred to this station by any transfer fingers. The pair of transfer fingers which travel between the blanking station and the next adjacent working station return to the blanking station in their open configuration and close to grip the blank by virtue of the ramps located at the blanking station as described above.

From the foregoing, it is seen that the present invention comprises a press apparatus wherein a plurality of workpieces are simultaneously transferred along a substantially circular path and a corresponding plurality of transfer assemblies which are arranged along the circular path. Each of the transfer assemblies is associated with a respective pair of successive adjacent working stations, each such pair including a first working station and a next successive second working station. Each transfer assembly positively grips a workpiece at the first working station of a respective pair of working stations, advances the gripped workpiece from the first to the second working station, releases the workpiece at the second working station and returns to the first working station whereby it positively grips the next workpiece which has been located at that first working station by a previous transfer assembly.

Although a particular mechanism for operation the transfer fingers has been described in connection with preferred embodiment, it is understood that other types of transfer assemblies and mechanisms for operating the same can be utilized within the scope of the present invention. Thus, for example, suitably placed eccentrics may be utilized to initiate the opening and closing of the transfer assemblies or, alternatively, a flexible band member having a variable diameter could be employed for the same purpose. In this connection, actuating mechanisms attached to the respective transfer fingers could be utilized employing conventional elements, such, for example, as universal joints and the like to actuate the transfer fingers between their open and closed modes.

Thus, the present invention provides a transfer press which, unlike the "linear" types of transfer presses, has a rotary arrangement whereby the workpieces are transferred along a circular path. The amount of space required for a particular sequence of operations for the present invention is significantly reduced through this circular arrangement relative to linear transfer presses. The full tonnage capabilities of the press are more efficiently utilized since the entire ram pressure is available at any working station or stations. The changing shapes of the workpieces can be accommodated through suitable configuration of the clamping ends of the transfer fingers of each transfer assembly and, further, through suitable selection of the inward movement limit stops provided with each transfer finger. The distance between work stations is relatively short so that press speeds can be increased. Further, illustrated preferred embodiment of the press apparatus is such that the die apparatus can be utilized with a conventional press since the transfer apparatus is readily removable therefrom. The workpieces are positively grasped at all times during transfer through the rotary transfer press of the present invention so that extremely close tolerances can be obtained and very high speeds achieved.

Another important advantage provided by the present invention is that by virtue of the circular configuration thereof, a relatively complex progressive die can be associated with one of the working stations so that a workpiece can be prepared in this progressive die and then introduced into the rotary transfer press apparatus for subsequent pressing operations. This has not been possible in the past in connection with conventional linear transfer presses due to their lack of room. It is also possible to provide for assembly operations at a particular working station in the apparatus of the present invention.

Figure 13A:
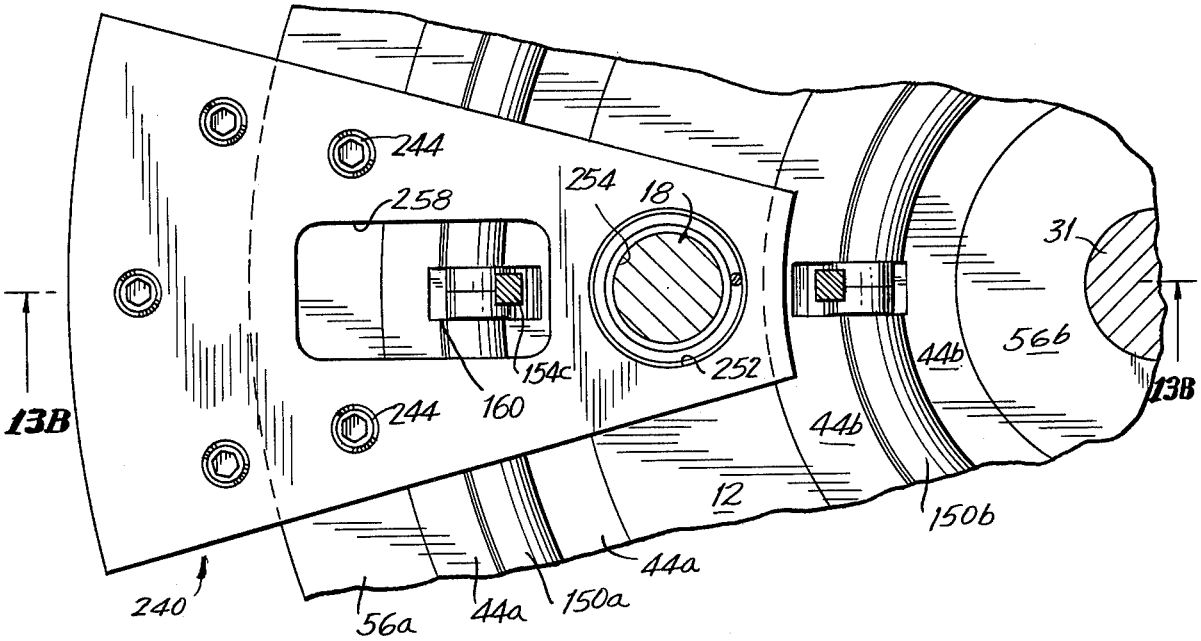
FIGS. 13A and B are top and side views respectively of a solid stripper which can be utilized in connection with the present invention.
Figure 13B:
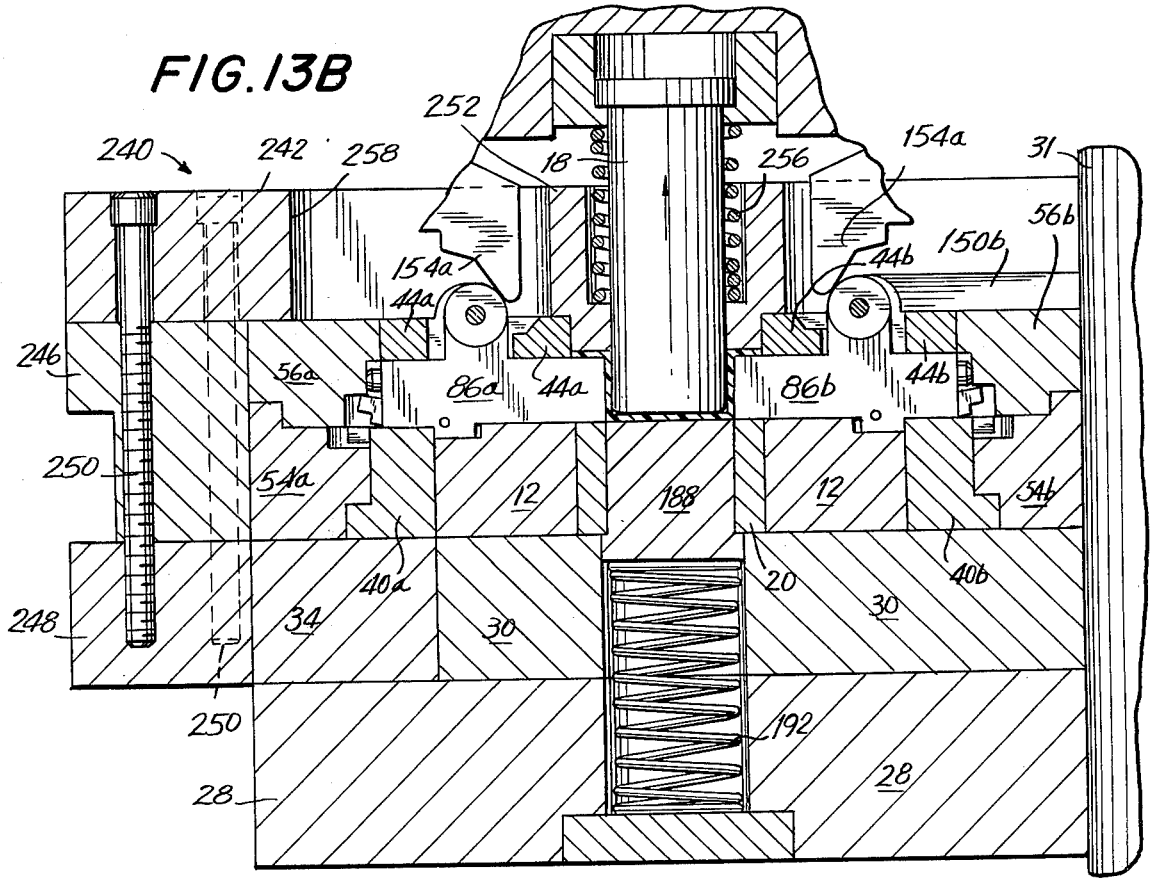

Optional Stripper Apparatus

Where the configuration of the workpiece is such that the stripping thereof from the punch as the latter ascends subsequent to the forming operation is rendered difficult utilizing the spring pin structure 180, it may be desired to provide a stripper assembly such as that shown in FIGS. 13A and 13B. Thus, the stripper assembly, generally designated 240 may be provided over one or more of the working stations as desired or may be omitted completely. The stripper assembly 240 comprises a relatively thick metallic stripper plate 242 having the shape of a circular segment, the plate 242 being connected to the hold-down ring 56*a* by means of bolts 244. To provide additional support for stripper plate 242, the latter is further connected to a riser block 246 which itself is connected to a shoe extension 248 by means of bolts 250. In this manner, the stripper plate 242 is cantilevered over the die member 20 of the working station. However, due to the relative thickness of the plate, there is little flexing thereof at the area over the die member 20 of the working station.

The stripper plate 242 has a circular well 252 formed axially with respect to die member 20 and having lower ends appropriately shaped to slide between the finger plates 44*a*, 44*b*. The well 252 has a bottom opening 254 through which the punch 18 extends during its stroke. As seen in FIG. 13B, a spring 256 is provided over punch 18 and extends between the upper press platen and the bottom of well 252. An opening 258 is formed through stripper plate 242 to provide clearance for the full action of the cam member 154*a* and to associated housing.

In operation, as the punch 18 withdraws from the die member 20, the workpiece tends to remain fixed over its surface until reaching the position illustrated in FIG. 13B which corresponds to point B on the cycle diagram of FIG. 5. At this point, due to the particular configuration of the workpiece, if the stripper plate 242 were not employed, the workpiece would tend to remain adhered onto the punch and continue ascent of the punch would tend to pull the workpiece from between the transfer fingers 86*a*, 86*b*. However, utilizing the stripper plate 242, continued ascent of the punch 18 causes the workpiece to engage the bottom surface of the well 252. As the punch ascends, the workpiece is stripped therefrom by engagement with the stripper plate 242.

Optional 2-up Blanking Operation

Figure 15:
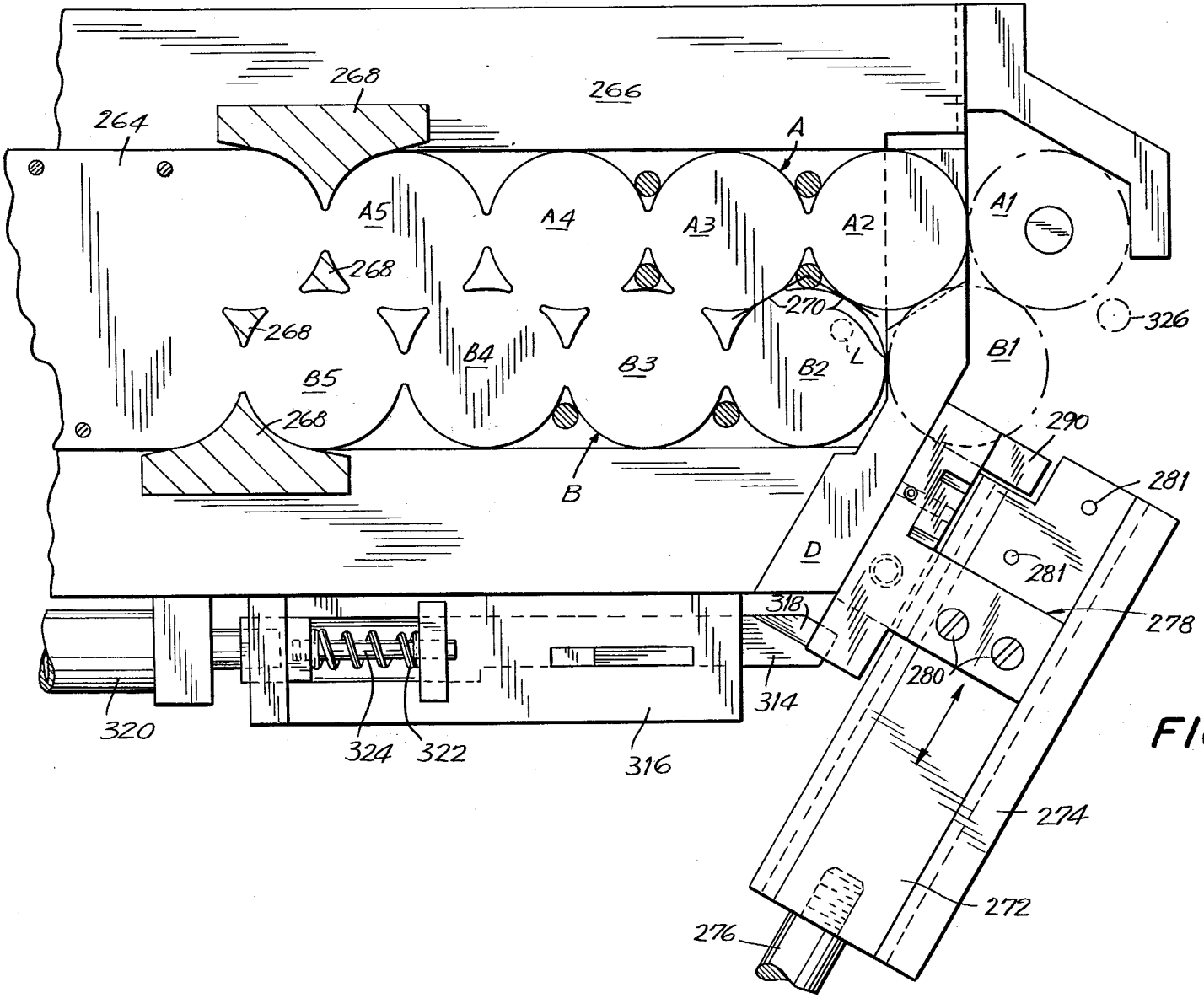
FIG. 15 is a plan view of a 2-up arrangement for the blanking station.
Figure 17:
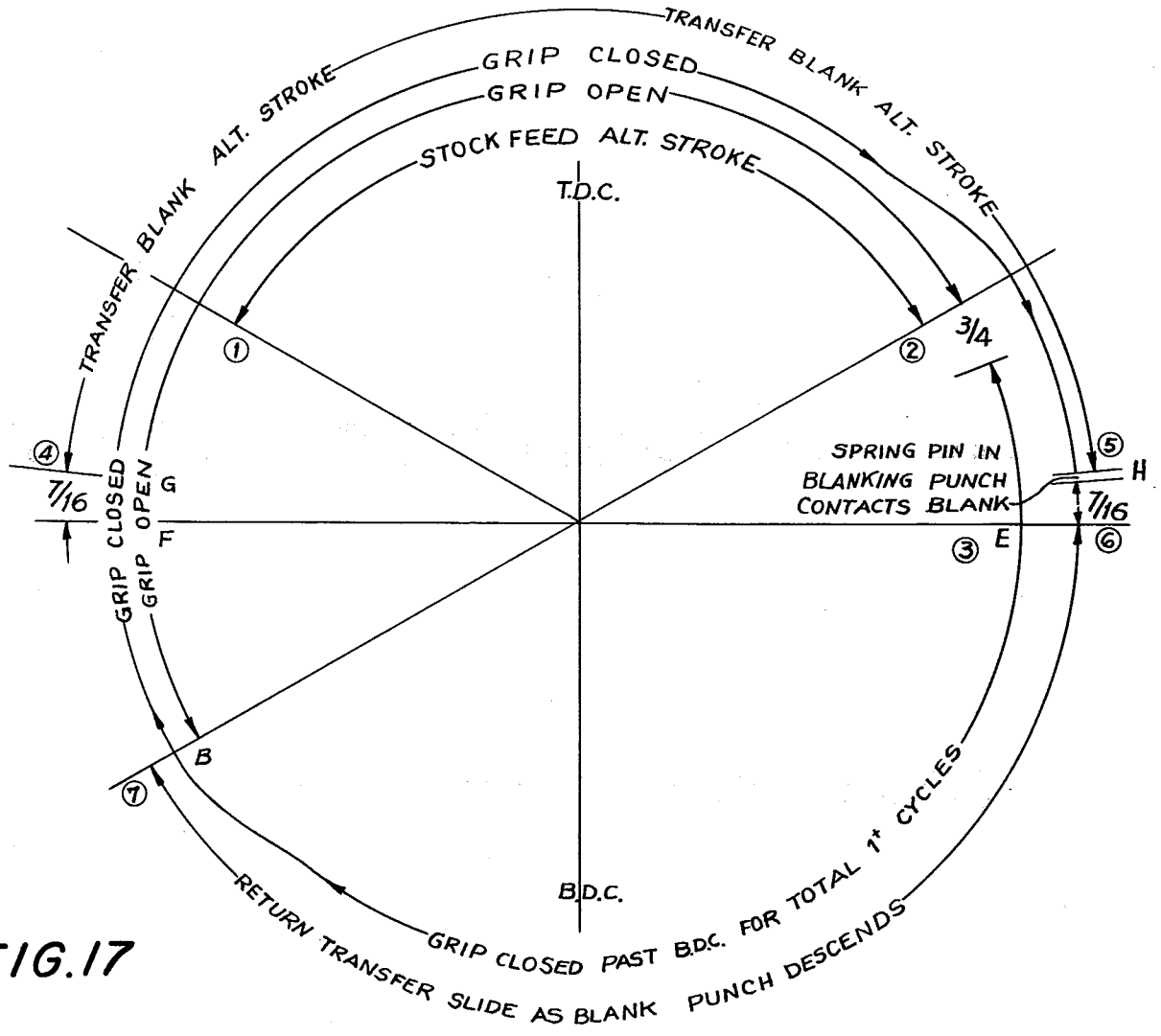
FIG. 17 is a cycle diagram illustrating the timed operation of the 2-up blanking station arrangement with respect to the press cycling for a complete press cycle.
Figure 16:
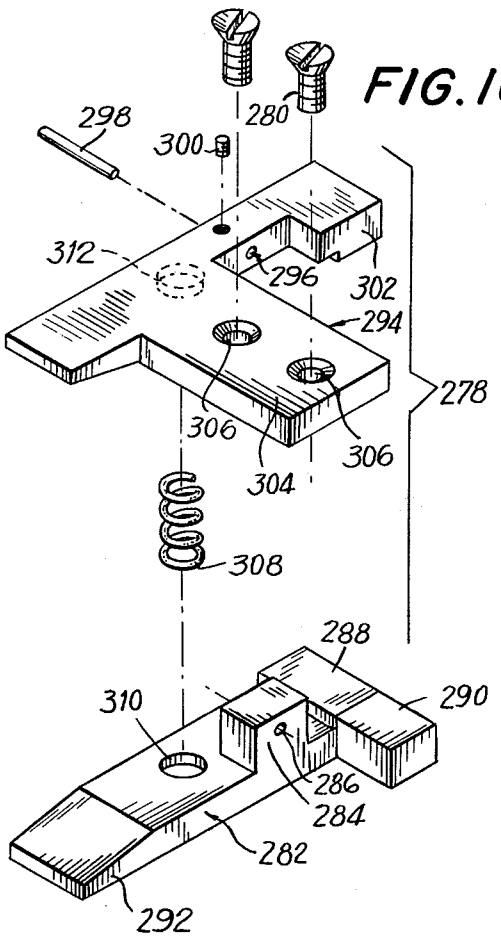
FIG. 16 is an exploded perspective view of the gripper members used in connection with the 2-up blanking station illustrated in FIG. 15.

Referring now to FIGS. 15–17, blanking apparatus is illustrated whereby a 2-up feed is accomplished so that the sheet stock need be advanced only during alternate press cycles. The illustrated structure can be incorporated with the press apparatus of the present invention in lieu of the 1-up feed structure described above. The use of the 2-up feed has been found to accomplish a material savings of up to 23%.

Referring to FIG. 15, sheet stock material 264 is fed on alternate strokes of the press, as described below, over a progressive or scroll die 266 having inserts 268 which cooperate with corresponding structure in the upper press platen so that the sheet stock material is scalloped to form two rows of circular blanks, designated row A and row B, the circular blanks of row A nesting at a one-half pitch distance between the blanks of row B. Thus, after progressing beyond the inserts 268, the blanks are attached to each other in the direction of feed and, additionally, each blank in row A is attached to the adjacent two blanks in row B. A V-shaped punch 270 severs the connection between the blanks in row A and row B so that as the stock is fed beyond the punch location, the A blanks are attached only to each other and, similarly, the B blanks are attached only to each other. Further, the sheet stock material of the B row is formed vertically higher than that of the A row an amount equal to the full thickness of the sheet stock.

A transfer slide 272 is slideably mounted within a guide 274, the latter being affixed to the hold down ring 56*a* as illustrated in FIG. 15 by means of connectors 281. Slide 272 is operatively associated with a two-way air cylinder 276 which is equipped with controls operated by a timing counter on alternate press strokes as described below. A gripper device 278 is fixed to transfer slide 272 by a pair of fasteners 280. Thus, referring to FIG. 16, the gripper device 278 comprises a lower gripper member 282 having an upwardly extending projection 284 having a bore 286 formed therethrough, a gripper portion 288 and a land portion 290 extending from the gripper portion 288. A rear end region 292 is provided at the opposite end of the lower gripper member 282. An upper gripper member 294 has a bore 296 formed therein which is axially aligned with bore 286 whereupon a pin 298 is inserted through the aligned bores so as to pivotally interconnect the lower and upper gripper members. A set screw 300 serves to fix the pin 298 in position. A gripper portion 302 is in opposed relationship to the gripper portion 288 of the lower gripper member and a bracket portion 304 extends laterally from the upper gripper member having a pair of bores 306 formed therethrough to receive the fasteners 280. A spring 308 has its ends received within respective lands 310, 312 which urges the rear end regions of the upper and lower gripper members away from each other thereby maintaining the gripper portions 288, 302 in a normally closed position.

Referring back to FIG. 15, an actuator rod 314 is slideably located within a housing 316. The actuator rod 314 has a beveled end portion 318 and the actuator rod is suitably positioned so that the end portion 318 thereof will engage the rear end region 292 of the lower gripper member 282 when the actuator rod 314 is in its forward position and the transfer slide 272 is in its rearward position as described below. The actuator rod 314 is operatively associated with an air cylinder 320 equipped with a timing control based on the operation of the press as described below. A spring 322 mounted over a shaft 324 normally urges the actuator rod 314 to its forward position as seen in FIG. 15.

Referring to FIG. 17 which comprises a cycle diagram depicting the operation of the 2-up feed structure and FIG. 15 which illustrates the configuration of the apparatus when the press is in the top half of its cycle, the operation of the apparatus will be described. It is understood that the row A is located so that it coincides with the feedline of the single feed configuration illustrated in FIG. 2.

As the press cycles between points 1 and 2 on the cycle diagram, the stock 264 is fed over the die 266 until the blank A1 is located over the blanking station. During this time, the air cylinders 276 and 320 are appropriately actuated so that the transfer slide 272 is in its retracted position as seen in FIG. 15 and so that the actuator rod 314 is in its forward position so that the end region 318 thereof engages the rear end region 292 of lower gripper member 282 so as to maintain the gripper portions 288, 302 apart from each other, i.e., open, to allow for the stock material to pass therethrough during its feed. As the press cycles between points 2 and 3 on the cycle diagram, the stock material is stationary and the blanking punch descends whereupon the spring pin located therein engages the blank A1 and, immediately thereafter, the punch contacts blank A1. During this time, the transfer slide 272 remains in its retracted position. However, the actuator rod 314 is retracted whereby the gripper device is closed so that blank B1 is gripped thereby. As the press cycles between points 3 and 4 on the cycle diagram the blank A1 is punched while the gripper device 272 grips blank B1, still in its retracted position. The punch, schematically illustrated at 270, upon reaching its bottom dead center position, shears the material connecting blank B2 to blanks A2 and A3 and, additionally, shears the material connecting blank B1 to blank B2 against die insert D while blank B1 is held by the gripper device. A lifting pin L located at a position beneath blank B2 functions to raise blank B2 so that the blank can be fed without interference at the point 1 on the cycle diagram. The blanked blank A1 is gripped by the transfer fingers at point B on the cycle diagram as in the case described above in connection with the 1-up feed. At point 4 on the cycle diagram, the air cylinder 276 is actuated whereby the transfer slide begins its advance movement carrying blank B. Between points 4 and 5 on the cycle diagram, the transfer slide 272 advances holding blank B1 until blank B1 is positioned over the blanking station. The spring pin in the blanking punch engages blank B1 against a lower spring pin and at point 6 on the cycle diagram, the blank B1 is securely gripped. At the same time, a push rod 326 fixed to the upper press platen engages the land 290 on the lower gripper member to open the gripper device whereupon the air cylinder 276 is deactivated so that the transfer slide 272 begins its retract movement. Between points 6 and 7 on the cycle diagram, the blanking punch descends to pick up blank B1 and, simultaneously, the transfer slide 272 retracts. At the same time, the air cylinder 320 is actuated so as to advance the actuator rod 314 so that upon the return of the transfer slide to its retracted position, the actuator rod is extended so that the end portion 318 thereof engages the rear end region 292 of the lower gripper member so that the gripper is open. Between points 7 and 1 on the cycle diagram, the apparatus is inactive and upon reaching point 1, the stock material 264 feeds forwardly until the blank A2 is located over the blanking station. The above recited process is then repeated.

In this manner, it is seen that the stock material need be advanced only during alternate press cycles and transfer slide 272 operates during the other press cycle. A minimum of material is wasted by the scroll design on the die. The ability to utilize a 2-up feed for the stock material emphasizes the unique adaptability of the rotary transfer press apparatus to various designs and apparatus.

Obviously, numerous modifications and variations of the present invention are possible in the light of the above teachings. Accordingly, it is understood that the invention can be practiced otherwise than specifically disclosed herein.

What is claimed is:

1. Rotary transfer press apparatus wherein each of a plurality of workpieces is sequentially transferred to a plurality of successive working stations so that the workpiece is successively formed to obtain a finished product, comprising:

a fixed die block having a plurality of successive working stations arranged along a substantially circular path, which working stations are adapted to perform corresponding successive working operations on a workpiece which is transferred along said circular path through said working stations to obtain a finished product subsequent to the last of the forming operations, each of said working stations including a die member into which each of a plurality of workpieces is brought into operative relation for performance of one of the successive forming operations;

a vertically reciprocatable upper press platen located over said die block having a plurality of punches, each of which extends coaxially with respect to the die member associated with a corresponding working station in said fixed die block, said punches having lower working end regions adapted to enter into and withdraw from said die members in corresponding working stations at substantially the same time during each reciprocating cycle of said upper press platen;

said upper press platen being adapted for vertical reciprocation so that said punches continuously cycle at a certain rate, each punch cycle including a downward stroke portion wherein said upper press platen travels from top dead center to bottom dead center and an upward stroke portion wherein said press platen travels from bottom dead center to top dead center; and means for sequentially transferring the plurality of workpieces simultaneously along said substantially circular path in a manner such that each workpiece is sequentially carried to each of the successive working stations where corresponding successive forming operations are performed thereon, said transfer means advancing each workpiece from one working station where a forming operation has been performed thereon during a press cycle to the next successive working station in preparation for the next successive forming operation to be performed during the immediately subsequent press cycle.

2. Rotary transfer press apparatus as recited in claim 1 wherein said workpiece transfer means comprises a plurality of transfer assemblies arranged along a substantially circular path, each of said transfer assemblies being associated with a respective pair of successive adjacent working stations, each of said pairs of successive adjacent working stations including a first working station and a next successive second working station, and wherein each of said transfer assemblies comprises means for positively gripping a workpiece at the first working station of a respective pair of successive work stations, for advancing the gripped workpiece from said first to said second working station of said respective working station pair, for releasing the workpiece at said second working station, and for returning to said first working station whereby said positive gripping means causes the transfer assembly to grip the next workpiece located at said first working station.

3. Rotary transfer press apparatus as recited in claim 2 further including means for causing each of plurality of transfer assemblies to substantially simultaneously positively grip a respective workpiece at said first working station of a respective pair of successive working stations during the upward stroke portion of a press cycle, means for causing each of the plurality of transfer assemblies to substantially simultaneously advance the workpiece gripped thereby from said first working station to said second working station of the respective working station pair while the upper press platen moves upwardly to top dead center and begins its downward stroke portion, means for causing each of the plurality of transfer assemblies to substantially simultaneously release the respective workpiece gripped thereby at said second working station of the respective working station pair as the upper press platen continues to move downwardly during said downward stroke portion, means for causing each of the plurality of transfer assemblies to substantially simultaneously return from said second working station to said first working station of the respective working station pair while the upper press platen moves downwardly to its bottom dead center position and begins its next upward stroke portion, whereby upon each of said transfer assemblies reaching said first working station of the respective working station pair, said means for causing each of the plurality of transfer assemblies to substantially simultaneously positively grip a workpiece is actuated so that the transfer assembly positively grips the next workpiece at said first working station during said next upward stroke portion.

4. Rotary transfer press apparatus as recited in claim 2 wherein each of said transfer assemblies comprise a pair of transfer fingers mounted in mutually opposed relationship with respect to each other, said transfer fingers having inner opposed clamping end portions and outer ends, one of said transfer fingers being an inner finger situated inside said circular path defined by said working stations and the other of said transfer fingers being an outer finger situated outside said circular path, and wherein said positive gripping means comprises closing means for moving the transfer fingers of each pair in a substantially radial direction with respect to said circular path inwardly towards each other from an open to a closed relationship to grip a workpiece at the first working station of a respective pair of adjacent successive working station, and wherein said advancing means comprises means for moving said transfer finger pair in said closed relationship with the workpiece gripped thereby along said circular path so that the workpiece is carried into operative relation with the second working station of said respective working station pair, and wherein said releasing means comprises opening means for moving the transfer fingers of each pair in a substantially radial direction with respect to said circular path outwardly away from each other from said closed to said open relationship to release said workpiece at the second working station of said working station pair, means for locking said transfer fingers of each pair in said open relationship, and wherein said return means comprise means for moving said transfer finger pair in said locked relationship along said circular path toward said first working station until said transfer finger pair is in gripping relation with respect to a next workpiece at said first working station, and means located at each respective first working station for unlocking said transfer fingers of each pair, whereupon said closing means moves the transfer fingers of each pair of their closed relationship to grip the next workpiece at the first working station of each respective working station pair.

5. Rotary transfer press apparatus as recited in claim 4 wherein said die block comprises a substantially annular member having outer and inner substantially circular peripheral surfaces further including a transfer ring assembly including integrally connected outer and inner transfer ring portions mounted adjacent to said outer and inner peripheral die block surfaces, respectively, for oscillating movement with respect thereto, the inner and outer transfer fingers of each of said plurality of transfer finger pairs being radially slidably mounted in radially aligned locations on said inner and outer ring portions, respectively, so that the clamping end portions of said inner and outer transfer fingers extend over inner and outer peripheral regions of said die block, and means for limiting the extent of movement of said transfer fingers inwardly towards each other and outwardly away from each other.

6. Rotary transfer press apparatus as recited in claim 5 wherein said means for limiting the extent of movement of said transfer fingers comprise a set screw provided in said inner and outer transfer ring portions adapted to engage the inner and outer transfer fingers, respectively, upon their inward movement to a closed relationship.

7. Rotary transfer press apparatus as recited in claim 5 wherein said advancing and return means comprise means for oscillating said transfer ring assembly with respect to said die block over an arcuate extent which substantially equals the arcuate distance between adjacent successive working stations.

8. Rotary transfer press apparatus as recited in claim 7 wherein said oscillating means comprise a worm gear coupled to the press drive apparatus and follower means mounted on said transfer ring assembly in cooperating relation with said worm gear.

9. Rotary transfer press apparatus as recited in claim 5 wherein said closing means comprise spring biasing means provided in each of said transfer fingers for constantly urging said transfer fingers of each pair in a radial direction toward each other.

10. Rotary transfer press apparatus as recited in claim 9 wherein a bore is formed in each of said transfer fingers which opens from the outer end thereof and said spring biasing means comprise a coil spring disposed within said bore extending from the open end thereof and being in continuous spring biasing contact with respective surfaces located adjacent said inner and outer transferring portions.

11. Rotary transfer press apparatus as recited in claim 5 wherein said means for locking said transfer fingers in their open relationship comprise latch means pivotally connected to each of said transfer fingers for locking each respective transfer finger in its outer open position upon said respective transfer finger being moved to said open position by said opening means at said second working station of each respective working station pair and for maintaining said transfer fingers in said outer open position as the same is returned to the first working station of said working station pair by said return means.

12. Rotary transfer press apparatus as recited in claim 11 wherein said latch means comprise a latch member pivotally connected to one end of each of said transfer fingers, the free end of which extends toward the outer end of the respective transfer finger and wherein a latching projection is formed on the free end of each latch member, and wherein said inner and outer transfer ring portions have inner and outer peripherally extending latch surfaces, respectively, said latching members which are connected to said inner and outer transfer fingers being adapted to pivot into locking position wherein said latching projections engage said inner and outer latch surfaces of said inner and outer transfer ring portions, respectively, upon said transfer fingers being moved outwardly away from each other.

13. Rotary transfer press apparatus as recited in claim 5 wherein said opening means comprises a plurality of cam assemblies fixed to said upper press platen arranged in a substantially circular path, each of said cam assemblies being associated with a corresponding respective working station in said die block, cam surfaces formed on each of said inner and outer transfer fingers in a manner such that upon said transfer finger pair being advanced to said second working station of each respective working station pair by said advancing means, said cam surfaces of each transfer finger pair are in substantial vertical alignment with a corresponding cam assembly, whereby during the downward stroke portion of said upper press platen, each of said cam assemblies engage the cam surfaces of a respective transfer finger pair thereby urging the transfer fingers thereof outwardly away from each other so that the workpiece grip thereby is released.

14. Rotary transfer press apparatus as recited in claim 13 wherein each of said cam assemblies comprise a pair of cam members, each of said cam member pairs including an inner cam member situated inside of said circular path defined by said cam assemblies and an outer cam member situated outside of said circular path, said inner and outer cam members adapted to engage the cam surfaces of the inner and outer transfer fingers, respectively, of a corresponding respective transfer finger pair.

15. Rotary transfer press apparatus as recited in claim 14 wherein each of said cam members is pivotally connected to said upper press platen about an axis directed substantially normally to the radius of said circular path defined by said cam assemblies, whereby upon continued downward movement of said upper press platen subsequent to engagement of said cam members with said cam surfaces in corresponding transfer fingers to cause their outward opening movement, said cam members pivot about said axes.

16. Rotary transfer press apparatus as recited in claim 4 wherein one of said working stations comprises a blanking station, said blanking station comprising a first working station of a pair of adjacent working stations, and wherein a progressive die is located over said die block.

17. Rotary transfer press apparatus as recited in claim 16 wherein said blanking station is a one-up blanking station.

18. Rotary transfer press apparatus as recited in claim 16 wherein said blanking station is a two-up blanking station.

19. Rotary transfer press apparatus as recited in claim 18 further including transfer slide means for reciprocating towards and away from said blanking station and gripper means attached to said tramsfer slide means for gripping a blank.

20. Rotary transfer press apparatus as recited in claim 4 and further including means provided in said punches and said die block for positively gripping said workpieces immediately prior to said punches contacting the same on the downward stroke portion and immediately subsequent to said punches disengaging from said workpieces on the upward stroke portion.

21. Rotary transfer press apparatus as recited in claim 4 and further including a stripper plate located over in cantilevered fashion at least one of said working stations, said stripper plate having an opening formed therein through which the respective punch can press.

* * * * *